US007720400B2

(12) United States Patent
Taguchi et al.

(10) Patent No.: US 7,720,400 B2
(45) Date of Patent: May 18, 2010

(54) IMAGE FORMING APPARATUS WITH CLEANER THAT REMOVES TONER FROM INTERMEDIATE TRANSFER MEDIUM

(75) Inventors: Keiichi Taguchi, Nagano-ken (JP); Masahiro Maeda, Nagano-ken (JP); Tatsuro Osawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 838 days.

(21) Appl. No.: 11/475,515

(22) Filed: Jun. 27, 2006

(65) Prior Publication Data

US 2007/0036569 A1 Feb. 15, 2007

(30) Foreign Application Priority Data

Aug. 11, 2005 (JP) ..... 2005-233082
Aug. 11, 2005 (JP) ..... 2005-233083
Aug. 11, 2005 (JP) ..... 2005-233086

(51) Int. Cl.
*G03G 15/00* (2006.01)

(52) U.S. Cl. ..... 399/49; 399/51; 399/55; 399/101; 399/301

(58) Field of Classification Search ..... 399/49, 399/51, 55, 101, 301
See application file for complete search history.

(56) References Cited

U.S. PATENT DOCUMENTS 5,107,285 A * 4/1992 Hamada et al. ..... 399/169
6,633,737 B1 10/2003 Tanaka et al.
6,832,060 B2 12/2004 Tanaka et al.
7,020,427 B2 * 3/2006 Hart ..... 399/350
7,283,756 B2 * 10/2007 Suzuki ..... 399/49
2004/0022561 A1 2/2004 Tanaka et al.
2004/0190950 A1 9/2004 Fujita et al.

(Continued)

FOREIGN PATENT DOCUMENTS

JP 05-224497 9/1993

(Continued)

OTHER PUBLICATIONS

English Abstract of Izumi, JP11258919.*

*Primary Examiner*—David M Gray
*Assistant Examiner*—Ryan D Walsh
(74) *Attorney, Agent, or Firm*—Hogan & Hartson LLP

(57) ABSTRACT

An image forming apparatus comprises: a latent image carrier which carries an electrostatic latent image; a developing unit which visualizes with toner the electrostatic latent image carried by the latent image carrier and forms a toner image; an intermediate transfer medium to which the toner image is transferred from the latent image carrier and which rotates and transports the toner image to a predetermined transfer position and transfers the toner image to a recording medium; a cleaner which abuts on the surface of the intermediate transfer medium and removes toner which adheres to the surface of the intermediate transfer medium after the transfer to the recording medium; and a controller which, assuming that the direction which is orthogonal to the travel direction in which the intermediate transfer medium moves is a width direction, executes toner accumulating processing during which predetermined toner images are formed as end patch images in end areas of the surface of the intermediate transfer medium which are located on outer side along the width direction relative to an image forming region in which a toner image corresponding to size of the recording medium is formed and the cleaner then removes the end patch images.

8 Claims, 18 Drawing Sheets

U.S. PATENT DOCUMENTS

2005/0053389 A1 3/2005 Tanaka et al.

FOREIGN PATENT DOCUMENTS

JP 11258919 A * 9/1999
JP 3026035 3/2000
JP 2001-235924 8/2001
JP 2002-351190 12/2002
JP 2004-163503 6/2004

* cited by examiner

FIG. 3A : CLEANING POSITION
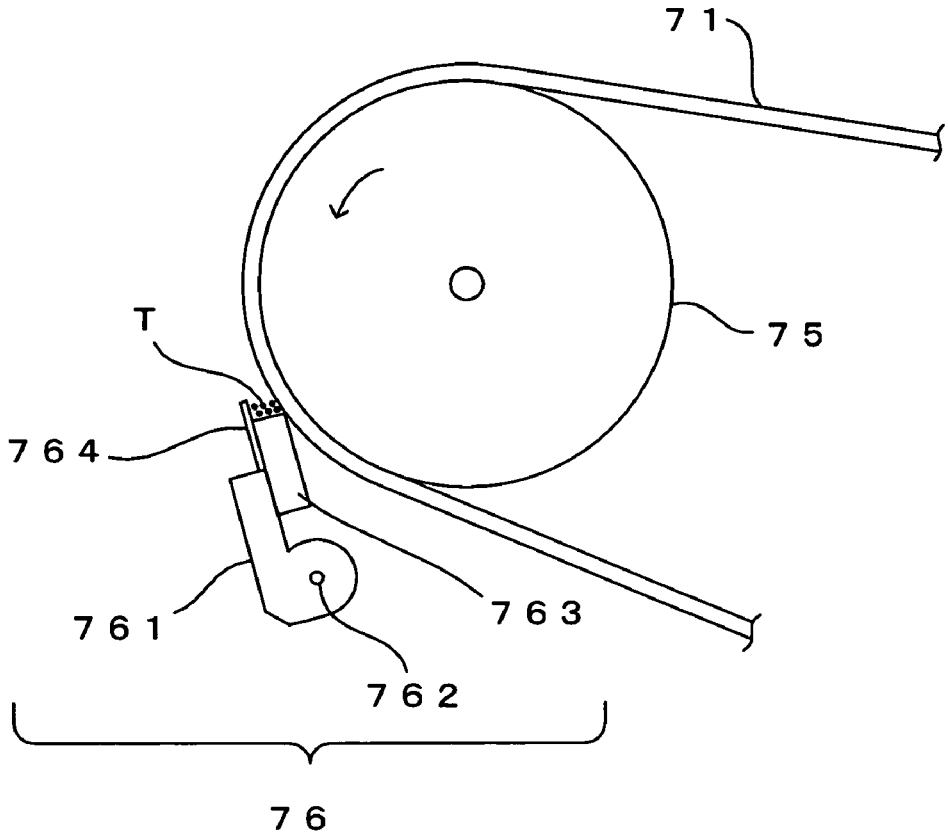
FIG. 3B : STAND-BY POSITION
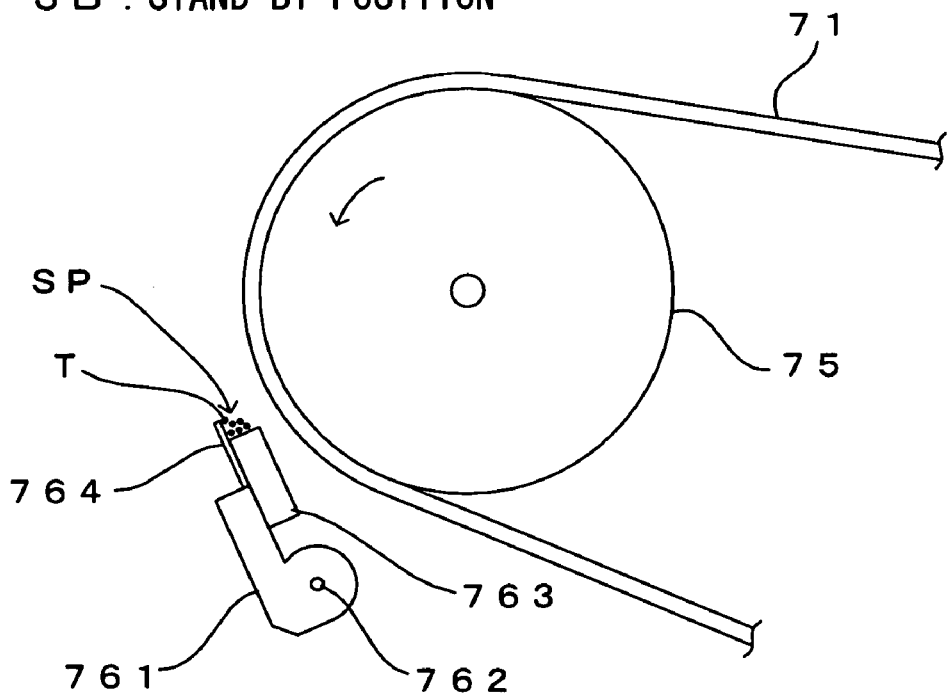

IMAGE FORMING APPARATUS WITH CLEANER THAT REMOVES TONER FROM INTERMEDIATE TRANSFER MEDIUM

CROSS REFERENCE TO RELATED APPLICATION

The disclosure of Japanese Patent Applications enumerated below including specifications, drawings and claims is incorporated herein by reference in its entirety:

No. 2005-233082 filed on Aug. 11, 2005;

No. 2005-233083 filed on Aug. 11, 2005; and

No. 2005-233086 filed on Aug. 11, 2005.

BACKGROUND

1. Technical Field

The present invention relates to an image forming apparatus comprising an image carrier which carries a toner image and a cleaner which abuts on the surface of the image carrier and removes toner, and to an image forming method which such an apparatus performs.

2. Related Art

Among image forming apparatuses of the electrophotographic type is an apparatus which comprises a cleaning blade (hereinafter referred to simply as a "blade") which removes toner remaining on an image carrier. In this type of apparatus, friction between the image carrier and the cleaning blade may sometimes cause a problem that the image carrier gets worn away or that the edges of the blade curl up or get damaged. An approach for prevention of this is to always secure accumulation of toner in an abutting section where the image carrier and the blade abut on each other. In the image forming apparatus described in Japanese Patent No. 3026035 for instance, an output patch image is formed all along the width of a cleaning blade which abuts on a photosensitive member which serves as an image carrier, and the cleaning blade scrapes off the output patch. This prevents the blade from curling up at its edges.

According to the conventional technique described above, an output patch is formed all along the width of the cleaning blade, including the inside of an image region. This invites a problem that formation of the output patch uses a great amount of toner and the running cost of the apparatus accordingly increases. In addition, since it is not possible to form an image as is usually done while the output patch is being formed, another problem arises that the throughput of the apparatus decreases.

Further, among image forming apparatuses of this type is an apparatus which is structured to execute a control operation (registration control) which aims at properly maintaining a toner image forming position on an image carrier. The image forming apparatus described in Japanese Unexamined Patent Application No. 2001-235924 for instance performs registration control in the following manner, to thereby handle a slight change of the rotation speed of an intermediate transfer belt, namely, an image carrier, which occurs when a cleaning blade abuts on and moves away from the intermediate transfer belt. In this apparatus, while changing how the cleaning blade abuts on the intermediate transfer belt, the rotation cycle of the intermediate transfer belt is measured in each state. Describing this in more specific details, the rotation cycle of the intermediate transfer belt is measured in four situations that: (1) the intermediate transfer belt comes abutting on the intermediate transfer belt while the intermediate transfer belt makes one revolution; (2) the abutting state is maintained during a revolution; (3) the cleaning blade starts moving away from the intermediate transfer belt while the intermediate transfer belt makes one revolution; and (4) the cleaning blade stays away during a revolution.

A transfer position at which a toner image will be transferred onto the intermediate transfer belt is controlled based on the result of the measurement. In other words, for transfer of a toner image onto the intermediate transfer belt, whether the rotation of the intermediate transfer belt corresponds to any one of (1) through (4) is determined, and the transfer position is shifted by a registration control amount calculated from the corresponding measured rotation cycle.

In the conventional image forming apparatus described above, immediately after power-on of the apparatus, the cycle of the intermediate transfer belt described above is measured as a part of initialization of the apparatus before forming an image. However, a special consideration is necessary when the intermediate transfer belt is new which may be when the apparatus is new or immediately after the intermediate transfer belt has been exchanged. The reason is as follows.

It is known that when the image forming apparatus of this type is in its actual operation, a part of toner removed off from the intermediate transfer belt (image carrier) by the cleaning blade (cleaner) accumulates in the section where the blade and the belt abut on each other, and this toner functions as a lubricant between the cleaner and the image carrier and mitigates friction between the blade and the belt. On the other hand, when the apparatus is new, no such toner accumulation has been made yet. Hence, when the apparatus is new, if the image carrier rotates with the cleaner abutting on the same and the cycle of the image carrier is measured, friction may damage the cleaner or the image carrier. This also is the same as measurement of the cycle of the image carrier in a different condition from that under which the apparatus actually operates, which may end up in deteriorating the accuracy of registration control.

In addition, among image forming apparatuses of this type structured so as to be able to mount multiple developers which store toner is such an apparatus which a user can choose whether to use it as a color image forming apparatus or a monochrome image forming apparatus by deciding whether to mount developers for mutually different toner colors or developers for the same toner color, in order to meet diversified user demands (Japanese Unexamined Patent Application No. 2002-351190).

In the case of such an apparatus, the content of processing to be executed as initialization must become different depending upon whether the apparatus is used as a color image forming apparatus or a monochrome image forming apparatus. For example, measurement of the cycle of the intermediate transfer belt described above is required for accurately superimposing toner images one atop the other on the intermediate transfer belt but is not necessary for a monochrome image forming apparatus which due to its nature does not superimpose toner images. Initialization according to the conventional technique nevertheless provides no consideration on this, leaving a room for improvement with respect to the efficiency of initialization.

SUMMARY

The first aspect of the invention is directed to an image forming apparatus for and an image forming method of visualizing with toner an electrostatic latent image carried by a latent image carrier, accordingly forming a toner image, transporting and transferring the toner image to an intermediate transfer medium and transferring the toner image to a recording medium, characterized in executing toner accumulating processing which comprises, assuming that the direction which is orthogonal to the travel direction in which the intermediate transfer medium moves is a width direction, a step of forming predetermined toner images as end patch images within end areas of the surface of the intermediate transfer medium which are located on the outer side along the width direction relative to an image forming region in which a toner image corresponding to the size of the recording medium is formed and a step of removing the end patch images using a cleaner which abuts on the intermediate transfer medium.

In this structure, the end patch images are formed in the end areas which are on the outer side to the image forming region and the cleaner scrapes off the end patch images. Since the efficiency of transferring a toner image from the intermediate transfer medium to the recording medium is less than 100%, execution of an image forming operation will leave, within the image forming region of the surface of the intermediate transfer medium, toner which has failed to get transferred onto the recording medium. The cleaner removes this toner a part of which accumulates in the abutting section where the intermediate transfer medium and the cleaner abut on each other. In short, it is not always necessary to supply toner functioning as a lubricant to the inside of the image forming region. Noting this, the invention requires supplying toner to the end areas which are on the outer side to the image forming region, thereby preventing without fail the edges of the cleaner from curling up within a wide area extending from the inside of the image forming region to outside the image forming region. In addition, since the amount of consumed toner is significantly less than where the conventional technique is implemented, it is possible to suppress an increase of the running cost of the apparatus.

The second aspect of the invention is directed to an image forming apparatus comprising an image carrier, which is capable of carrying on its surface a toner image and which rotates in a predetermined direction, an image forming unit, to which multiple developers storing toner can be mounted and which forms toner images on the image carrier using the toner within the developers, and a cleaner which abuts on the image carrier and removes residual toner remaining on the surface of the image carrier, and is directed also to an image forming method which uses such an image forming apparatus. According to the second aspect of the invention, when the image forming unit is in a multi-color state in which multiple developers storing toner of mutually different colors are mounted, the apparatus is made to operate as a color image forming apparatus capable of forming a color image. While when the image forming unit is in a single-color state in which a developer storing toner of a particular color is mounted, the apparatus is made to operate as a monochrome image forming apparatus capable of forming only a monochrome image in the particular color. Further, when the image carrier is new, whether the image forming unit is in the multi-color state or the single-color state is judged and predetermined initializing operation of making the image carrier ready for use to form a toner image is executed in accordance with the judgment result.

In this structure, in accordance with the toner colors of the developers mounted to the apparatus, whether to operate the apparatus as a color image forming apparatus or a monochrome image forming apparatus is determined. That is, when the apparatus is in the multi-color state, i.e., when multiple developers are mounted and these developers hold toner of mutually different colors, the apparatus is made operate as a color image forming apparatus. Meanwhile, when the apparatus is in the single-color state, i.e., when the color of toner held in the mounted developers is a single color, the apparatus is made operate as a monochrome image forming apparatus which is dedicated to form a monochrome image in this color. The apparatus can thus be used in different ways in response to diversified user demands.

The third aspect of the invention is directed to an image forming apparatus comprising an image carrier, which is capable of carrying on its surface a toner image and which rotates in a predetermined direction, and a cleaner, which is structured to freely abutting on and moving away from the image carrier and which removes residual toner remaining on the surface of the image carrier while abutting on the image carrier, and is directed also to an image forming method which uses such an image forming apparatus. According to the third aspect of the invention, when it is determined that the image carrier is new, toner accumulating processing, during which an image forming unit forms a toner-accumulating toner image having a predetermined pattern on the image carrier, this toner image is transported to an abutting section where the image carrier and the cleaner abut on each other, and toner accumulates in the abutting section, and cycle measuring processing, during which the rotation cycle of the image carrier is measured while the image carrier makes a revolution in a condition that the cleaner abuts on the image carrier, are executed in this order, and for forming an image, registration control of controlling an image forming position on the image carrier is executed based on the result of the measurement obtained through the cycle measuring processing.

In this structure, when the image carrier is new, the toner accumulating processing is executed first, which is followed by the cycle measuring processing. In other words, the cycle measuring processing is carried out with toner accumulating in the abutting section between the image carrier and the cleaner. This reduces friction between the image carrier and the cleaner, suppresses wear of the image carrier and the cleaner, extends the life of the apparatus and decreases the running cost of the apparatus. Further, since the cycle measuring processing is performed approximately in the same state as that under which the apparatus operates, it is possible to precisely execute registration control based on the measurement result. This similarly applies to where the cleaner is new.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIGS. 3A and 3B are drawings which show the structure of the cleaner according to this embodiment;

DESCRIPTION OF EXEMPLARY EMBODIMENTS

Figure 1:
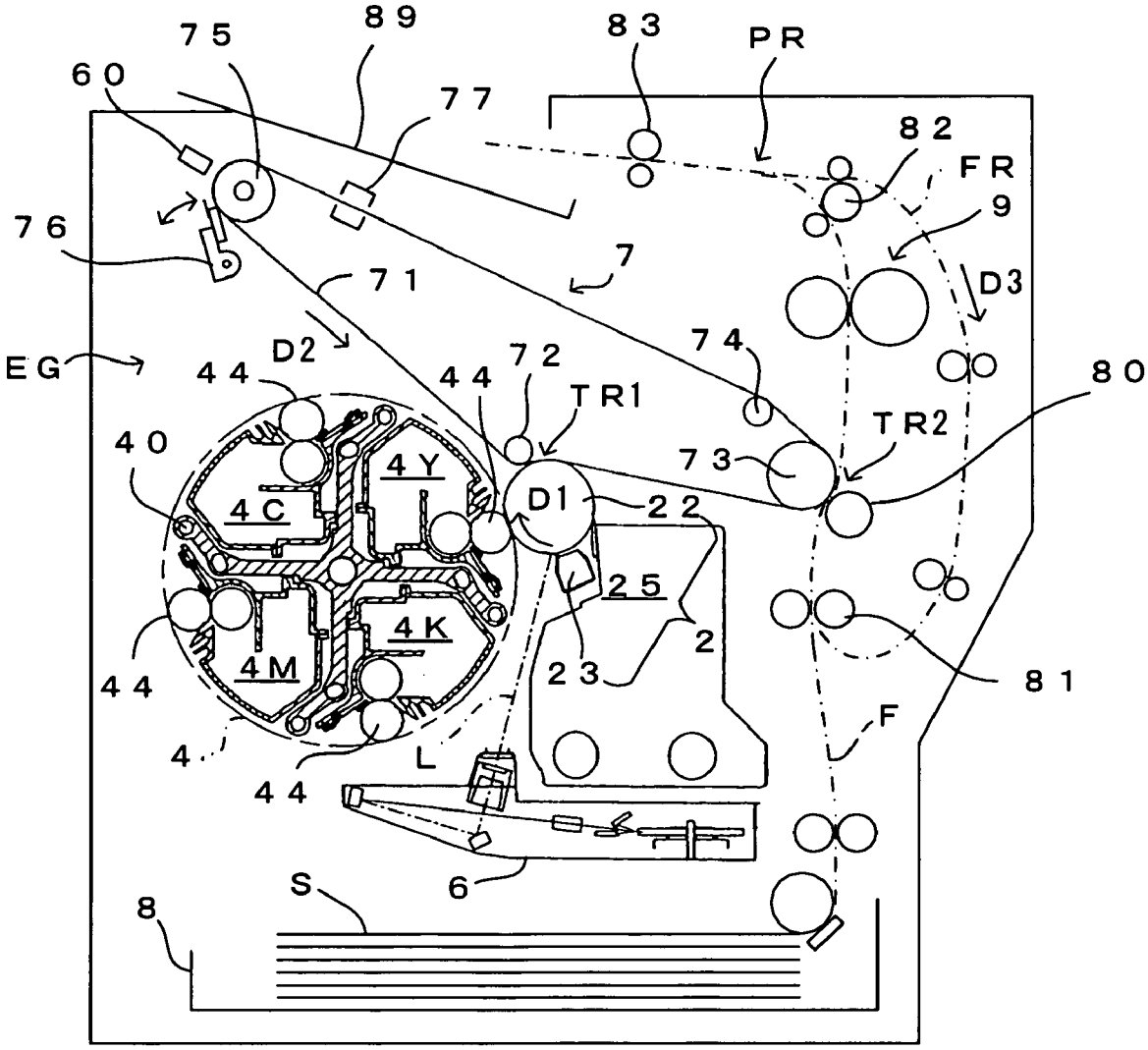
FIG. 1 is a drawing which shows an embodiment of the image forming apparatus according to the invention.
Figure 2:
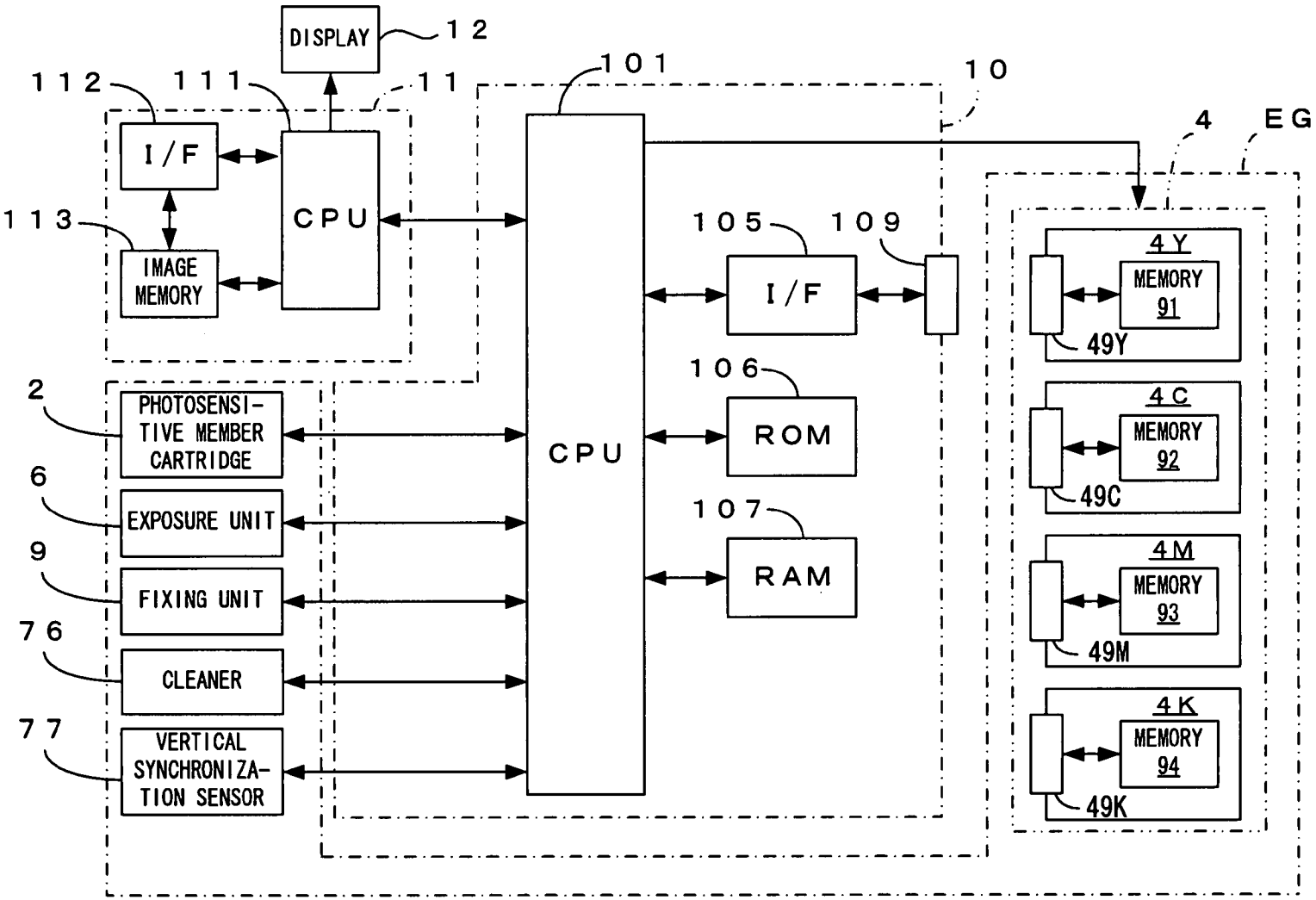
FIG. 2 is a block diagram of the electric structure of the image forming apparatus shown in FIG. 1.

FIG. 1 is a drawing which shows an embodiment of the image forming apparatus according to the invention. FIG. 2 is a block diagram of the electric structure of the image forming apparatus shown in FIG. 1. The illustrated apparatus is an apparatus which overlays toner in four colors of yellow (Y), cyan (C), magenta (M) and black (K) one atop the other and accordingly forms a full-color image, or forms a monochrome image using only black toner (K). In the image forming apparatus, when an image signal is fed to a main controller 11 from an external apparatus such as a host computer, a predetermined image forming operation is performed. That is, an engine controller 10 controls respective portions of an engine part EG in accordance with an instruction received from the main controller 11, and an image which corresponds to the image signal is formed on a sheet S.

In the engine part EG, a photosensitive member 22 is disposed so that the photosensitive member 22 can freely rotate in the arrow direction D1 shown in FIG. 1. Around the photosensitive member 22, a charger unit 23, a rotary developer unit 4 and a cleaner 25 are disposed in the rotation direction D1. A predetermined charging bias is applied upon the charger unit 23, whereby an outer circumferential surface of the photosensitive member 22 is charged uniformly to a predetermined surface potential. The cleaner 25 removes toner which remains adhering to the surface of the photosensitive member 22 after primary transfer, and collects the toner into a used toner tank which is disposed inside the cleaner 25. The photosensitive member 22, the charger unit 23 and the cleaner 25, integrated as one, form a photosensitive member cartridge 2. The photosensitive member cartridge 2 can be freely attached to and detached from a main section of the apparatus as one integrated unit.

An exposure unit 6 emits a light beam L toward the outer circumferential surface of the photosensitive member 22 which is thus charged by the charger unit 23. The exposure unit 6 makes the light beam L expose on the photosensitive member 22 in accordance with an image signal fed from the external apparatus and forms an electrostatic latent image which corresponds to the image signal.

The developer unit 4 develops thus formed electrostatic latent image with toner. The developer unit 4 comprises a support frame 40 which is disposed for free rotations about a rotation shaft which is perpendicular to the plane of FIG. 1, and also comprises a yellow developer 4Y, a cyan developer 4C, a magenta developer 4M and a black developer 4K which house toner of the respective colors and are formed as cartridges which are freely attachable to and detachable from the support frame 40. The engine controller 10 controls the developer unit 4. The developer unit 4 is driven into rotations based on a control instruction from the engine controller 10. When the developers 4Y, 4C, 4M and 4K are selectively positioned at a predetermined developing position which abuts on the photosensitive member 22 or is away a predetermined gap from the photosensitive member 22, toner of the color corresponding to the selected developer is supplied onto the surface of the photosensitive member 22 from a developer roller 44 disposed to the selected developer which carries toner of this color and has been applied with the predetermined developing bias. As a result, the electrostatic latent image on the photosensitive member 22 is visualized in the selected toner color.

A toner image developed by the developer unit 4 in the manner above is primarily transferred onto an intermediate transfer belt 71 of a transfer unit 7 in a primary transfer region TR1. The transfer unit 7 comprises the intermediate transfer belt 71 which runs across a plurality of rollers 72 through 75, and a driver (not shown) which drives a roller 73 into rotations to thereby rotate the intermediate transfer belt 71 along a predetermined rotation direction D2. For transfer of a color image on the sheet S, toner images in the respective colors on the photosensitive member 22 are superposed one atop the other on the intermediate transfer belt 71, thereby forming a color image. Further, on the sheet S unloaded from a cassette 8 one at a time and transported to a secondary transfer region TR2 along a transportation path F, the color image is secondarily transferred.

In other words, the toner image transported to the secondary transfer region TR2 as it is carried by the intermediate transfer belt 71 is secondarily transferred upon the sheet S which moves passed a nip area which is between the intermediate transfer belt 71 and a secondary transfer roller 80. The secondary transfer roller 80 is structured so as to abut on and move away from the surface of the intermediate transfer belt 71. In a condition that the secondary transfer roller 80 is away from the intermediate transfer belt 71, the toner image on the intermediate transfer belt 71 moves passed as it is the secondary transfer region TR2 while remaining on the intermediate transfer belt 71, and gets transported further toward the downstream side.

At this stage, for the purpose of properly transfer the image on the intermediate transfer belt 71 onto the sheet S at a predetermined position, the timing of feeding the sheet S to the secondary transfer region TR2 is managed. Describing this in more specific details, there is a gate roller 81 before the secondary transfer region TR2 on the transportation path F. As the gate roller 81 rotates timed to the rotations of the intermediate transfer belt 71, the sheet S is fed to the secondary transfer region TR2.

A fixing unit 9 fixes the toner image now borne by the sheet S, and the sheet S is transported to a discharge tray part 89, which is attached to the top surface of the main apparatus section, via a pre-discharge roller 82 and a discharge roller 83. In the event that images are to be formed on the both surfaces of the sheet S, the discharge roller 83 start rotating in the reverse direction upon arrival of the rear end of the sheet S, which carries an image on its one surface as described above, at a reversing position PR behind the pre-discharge roller 82, thereby transporting the sheet S in the arrow direction D3 along a reverse transportation path FR. While the sheet S is returned back to the transportation path F again before arriving at the gate roller 81, the surface of the sheet S which abuts on the intermediate transfer belt 71 in the secondary transfer region TR2 and is to receive a transferred image is at this stage is opposite to the surface which already bears the earlier image. In this fashion, it is possible to form images on the both surfaces of the sheet S.

Further, there is a cleaner 76 in the vicinity of the roller 75. The cleaner 76 can freely abut on and move away from the roller 75, owing to an electro-magnetic clutch not shown. In a condition that the cleaner 76 has moved to the roller 75, the blade of the cleaner 76 abuts on the surface of the intermediate transfer belt 71 spanning around the roller 75 and removes toner which remains adhering to the outer circumferential surface of the intermediate transfer belt 71 even after the secondary transfer.

During image transfer onto the sheet S within the secondary transfer region TR2, the cleaner 76 is controlled to abut on for removal of toner remaining on the intermediate transfer belt 71 during the same belt revolution for the image transfer. Hence, for the apparatus to continuously form monochrome images for instance, as an image transferred onto the intermediate transfer belt 71 within the first transfer region TR1 gets immediately transferred onto the sheet S within the secondary transfer region TR2, the cleaner 76 remains abutting on the belt. In the meantime, to form a color image, the cleaner needs be away from the intermediate transfer belt 71 while toner images in the respective colors are being superimposed one atop the other. In the same belt revolution during which the toner images in the respective colors are superimposed one atop the other and a resulting full-color image is secondarily transferred onto the sheet S, the cleaner 76 abuts on the intermediate transfer belt 71 to remove the remaining toner. The structure and the operation of the cleaner 76 will be described in detail later.

Further, there are a density sensor 60 and a vertical synchronization sensor 77 in the vicinity of the roller 75. The density sensor 60 is disposed facing the surface of the intermediate transfer belt 71, and measures the image density of a toner image formed on the outer circumferential surface of the intermediate transfer belt 71 when needed. This apparatus adjusts the operating conditions for the respective portions of the apparatus which influence the quality of an image, such as a developing bias applied upon each developer and the intensity of the light beam L, based on the measurement result. The density sensor 60 is structured so as to output, using a reflection-type photosensor for example, a signal which corresponds to the image density in an area having a predetermined size on the intermediate transfer belt 71. Rotating the intermediate transfer belt 71 and regularly sampling the output signal from the density sensor 60, the CPU 101 detects the image densities of the respective parts of a toner image on the intermediate transfer belt 71.

Meanwhile, the vertical synchronization sensor 77 is a sensor which detects a reference position of the intermediate transfer belt 71, and serves as a sensor for obtaining a synchronizing signal which is output in association with the rotations of the intermediate transfer belt 71, namely, a vertical synchronizing signal Vsync. In this apparatus, for the purpose of aligning the timing at which the respective portions operate and accurately overlaying toner images formed in the respective colors one atop of the other, the operations of the respective portions of the apparatus are controlled in accordance with the vertical synchronizing signal Vsync. The CPU 101 counts the vertical synchronizing signal Vsync.

Further, as shown in FIG. 2, the developers 4Y, 4C, 4M and 4K respectively mount memories 91 through 94 which store data regarding the production batches and the usage histories, the remaining toner amounts and the like of the associated developers. Wireless communication units 49Y, 49C, 49M and 49K are additionally disposed to the developers 4Y, 4C, 4M and 4K. When needed, these units selectively establish non-contact data telecommunications with a wireless communication unit 109 which is disposed to the main apparatus section and data are transferred between the CPU 101 and the respective memories 91 through 94 via the interface 105, thereby managing various types of information regarding the developers such as information on management of consumables. Although non-contact data transfer is done through wireless telecommunications which are established electromagnetically according to this embodiment, connectors or the like may be disposed to the main apparatus section and the respective developers and the main apparatus section and the respective developers may transfer data with each other as the connectors or the like are mechanically fit to each other.

In addition, this apparatus comprises a display 12 which a CPU 111 of the main controller 11 controls, as shown in FIG. 2. The display 12 is formed by a liquid crystal display for instance, and in response to a control command from the CPU 111, shows predetermined messages to inform a user of operation guidance, the progress of the image forming operation, the occurrence of abnormality in the apparatus, the timing of exchange any unit, etc.

In FIG. 2, denoted at 113 is an image memory which is disposed to the main controller 11 to store an image fed through the interface 112 from an external apparatus such as a host computer. Denoted at 106 is a ROM which stores a calculation program executed by the CPU 101, control data for control of the engine part EG, etc. Denoted at 107 is a RAM which temporarily stores a calculation result derived by the CPU 101, other data, etc.

This image forming apparatus is used as it mounts the four developers which hold toner of the mutually different colors as described above, but when one developer or multiple developers holding toner of the same color are mounted, the apparatus is used as an image forming apparatus dedicated to a monochrome image. In short, this image forming apparatus, when mounting only one developer, operates as an apparatus which forms a monochrome image of the corresponding toner color. Further, when mounting multiple developers holding toner of the same color, this image forming apparatus operates as an apparatus which forms monochrome images of that toner color using one of the developers or while appropriately switching between the developers.

FIGS. 3A and 3B are drawings which show the structure of the cleaner according to this embodiment. As shown in FIG. 3A, in the cleaner 76, a blade 763 which contacts the intermediate transfer belt 71 and scrapes off toner is attached to an arm member 761 which is capable of freely revolving about a rotation shaft 762. The blade 763 is made of an elastic material which may be urethane rubber for example, and shaped like a plate which extends along the width direction which is orthogonal to the travel direction in which the intermediate transfer belt 71 moves (i.e., the direction orthogonal to the plane of FIG. 3A). There is a toner stopper sheet 764 at the edge surface of the blade 763 which is opposite to the surface of the blade 763 which is opposed against the roller 75. The toner stopper sheet 764 is a sheet-like member of resin with which the blade 763 is lined.

The cleaner 76 having this structure revolves about the rotation shaft 762 when driven by a drive mechanism not shown. The blade 763 is therefore switched between its state that it abuts on the intermediate transfer belt 71 (FIG. 3A) and its state that it stays away from the intermediate transfer belt 71 (FIG. 3B). Describing this in more specific details, as the rotation shaft 762 is driven in the clockwise direction in FIG. 3B when the cleaner 76 is at its stand-by position (FIG. 3B) at which the blade 763 is off the intermediate transfer belt 71, the tip of the blade 763 moves from the left to the right in FIG. 3B and contacts the intermediate transfer belt 71 (cleaning position, FIG. 3A). In this instance, the tip of the blade moves approximately horizontally.

While abutting on the intermediate transfer belt 71, the blade 763 scrapes off toner which adheres on the intermediate transfer belt 71. Thus scraped-off toner T builds up within a space which is enclosed by the intermediate transfer belt 71, the blade 763 and the toner stopper sheet 764 on the upstream side to an abutting section of the intermediate transfer belt 71 and the blade 763 along the transportation direction of the intermediate transfer belt 71, as shown in FIG. 3A. The accumulated toner T functions as a lubricant in the abutting section where the intermediate transfer belt 71 and the blade 763 abut on each other and reduces frictional resistance between the intermediate transfer belt 71 and the blade 763, which obviates wear of the intermediate transfer belt 71 and prevents the ends of the blade 763 from curling up.

On the contrary, the blade 763 moves away from the intermediate transfer belt 71 when the cleaner 76 moves to the stand-by position. As this occurs, the toner T accumulated near the tip of the blade 763 will fall off from the blade 763 but for the toner stopper sheet. In this embodiment however, since there is the toner stopper sheet 764, the toner will not drop but stay in a space between the blade 763 and the toner stopper sheet 764 (toner reservoir space) SP as shown in FIG. 3B.

As described above, according to this embodiment, even when the blade 763 is away from the intermediate transfer belt 71, a certain amount of toner remains accumulated in the vicinity of the tip of the blade 763. Hence, as the blade 763 moves toward the intermediate transfer belt 71, abuts on the surface of the intermediate transfer belt 71 and stops moving, the resulting recoil feeds the toner T which used to stay in the toner reservoir space SP to this abutting section or to an upstream region relative to the abutting section along the travel direction in which the intermediate transfer belt 71 moves. This lubrication effect of the toner significantly reduces wear of the intermediate transfer belt 71 and prevents the ends of the blade 763 from curling up.

Figure 4:
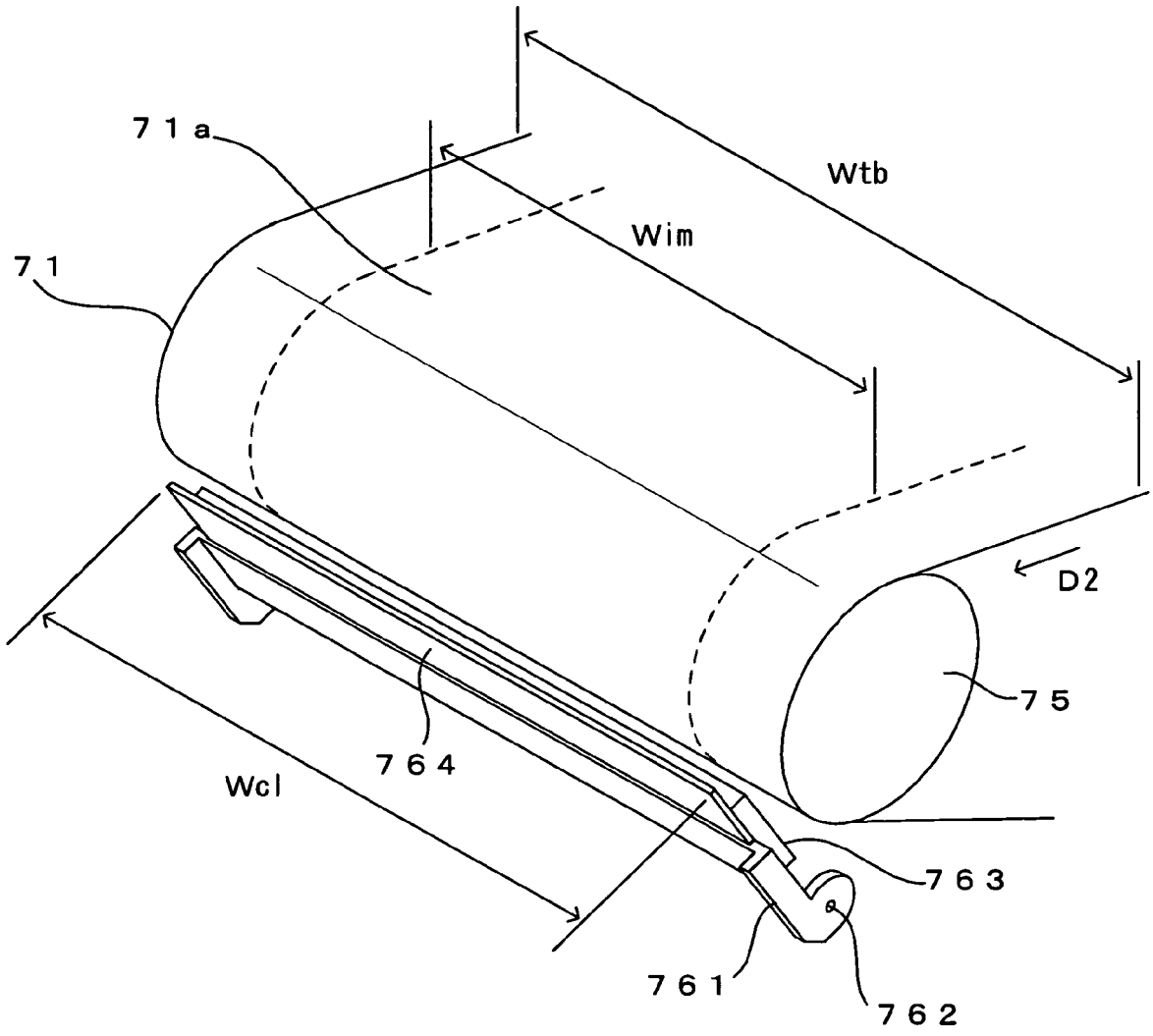
FIG. 4 is a perspective view for describing the dimensions of the cleaner and the intermediate transfer belt.

FIG. 4 is a perspective view for describing the dimensions of the cleaner and the intermediate transfer belt. The intermediate transfer belt 71 does not bear an image all along its width. An image is formed only in a predetermined image forming region (the region between the two broken lines in FIG. 4) 71*a* which corresponds to the size of the sheet S. The width of the blade 763 of the cleaner 76 is set to be wider than the width of the image forming region 71*a* but narrower than the width of the intermediate transfer belt 71. That is, where the symbol Wtb denotes the width of the intermediate transfer belt 71, the symbol Wim denotes the width of the image forming region and the symbol Wcl denotes the width of the blade 763, the widths satisfy the following relationship:

$$Wtb > Wcl > Wim$$

As the width Wcl of the blade 763 is wider than the width Wim of the image forming region 71*a*, it is possible to remove toner adhering to the image forming region and a surrounding area without fail, and therefore, prevent a next image from getting smeared. The excessively wide width of the blade 763 however, e.g., the width as wide as the width Wtb of the intermediate transfer belt 71 could backfire. In other words, the blade 763 abutting on the intermediate transfer belt 71 serves as a load upon a motor (not shown) which drives the belt 71 into rotations, and further, since the blade 763 abuts on and movers away from the intermediate transfer belt 71, the blade 763 could vary the rotation speed of the intermediate transfer belt 71. In addition, toner failing to get transferred to the sheet S in the secondary transfer region TR2 during the image forming operation will remain within the image forming region 71*a*, and this toner will serve as a lubricant when scraped off by the blade 763. On the contrary, there is only a very small amount of such toner present outside the image forming region 71*a*, friction between the intermediate transfer belt 71 and the blade 763 intensifies outside the image forming region 71*a*, and the intermediate transfer belt 71 and the blade 763 therefore can easily get worn or damaged in this area. Noting this, the width Wcl of the blade 763 is ideally as narrow as possible but needs be wider than the width of the image forming region 71*a*.

In the event that the apparatus is capable of handling multiple types of sheets whose sizes are different, the width of the blade 763 may be wider than the width of the image forming region which corresponds to the widest sheet.

The width of the toner stopper sheet will now be considered. The problems such as wear of the intermediate transfer belt 71 and the curled ends of the blade 763 owing to friction between the intermediate transfer belt 71 and the blade 763 can occur all over the area where the two are in contact. Hence, the toner stopper sheet 764 which controls this preferably spans all along the width of the blade 763. In short, the width of the toner stopper sheet 764 is preferably equal to or wider than the width Wcl of the blade 763. The toner stopper sheet 764 may stretch beyond the blade 763.

Figure 5:
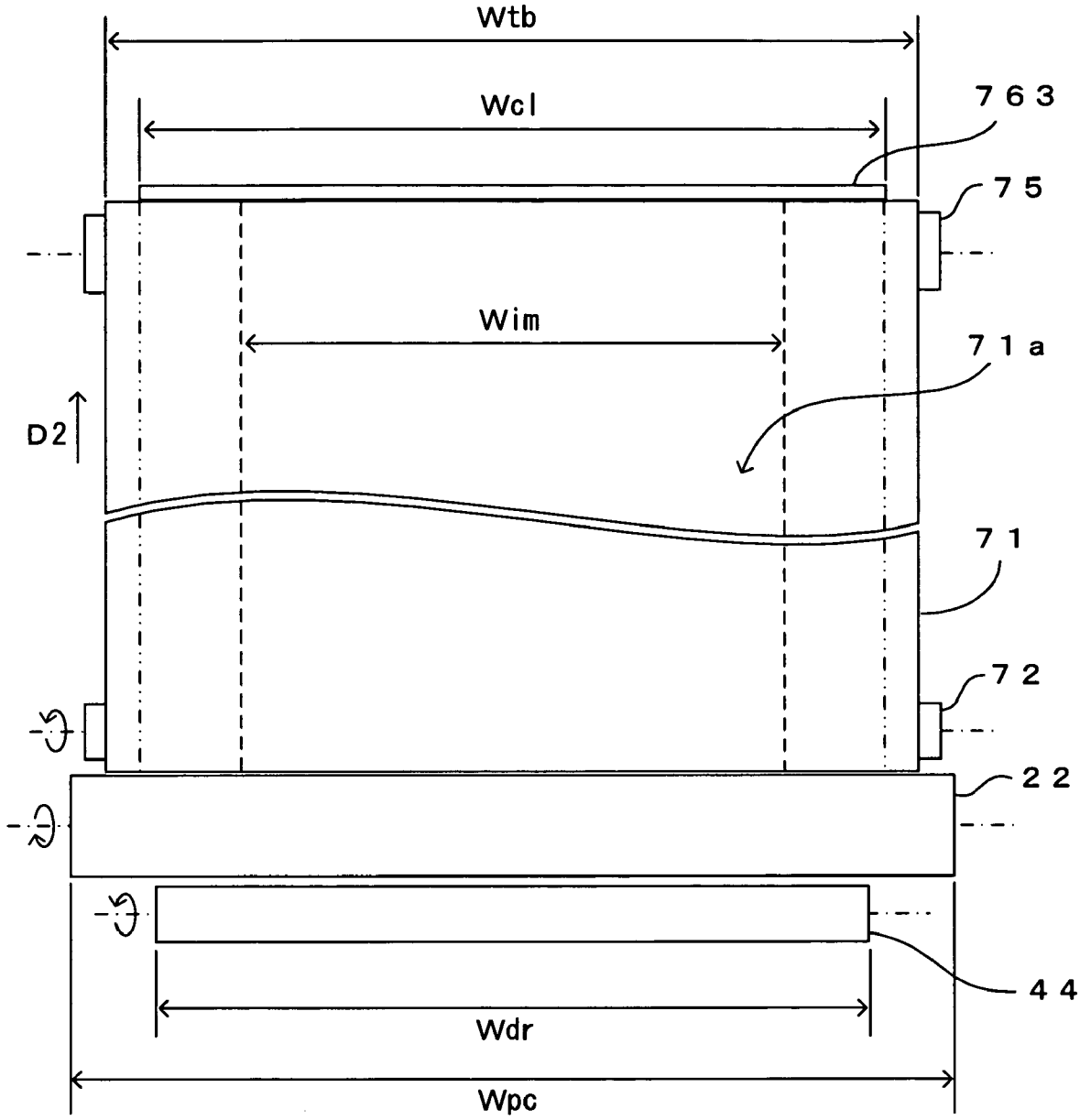
FIG. 5 is a drawing for describing a relationship between the width of the members.

FIG. 5 is a drawing for describing a relationship between the width of the members. As shown in FIG. 5, the width Wpc of the photosensitive member 22 is wider than the width Wtb of the intermediate transfer belt 71. The width Wdr of a developer roller 44 is naturally wider than the width Wim of the image forming region on the intermediate transfer belt 71 but slightly narrower than the width Wcl of the blade 763. Put in other words, the cleaning blade 763 is formed wider than the developer roller 44. This is because the wider cleaning blade 763 than the developer roller 44 permits securely cleaning toner which has moved to the intermediate transfer belt 71 from the developer roller 44 via the photosensitive member 22 and hence preventing unremoved toner from soiling the sheet S, the secondary transfer roller 80, etc. The width Wdr of the developer roller herein referred to is the width of an area within the surface of the developer roller 44 where it is possible to carry toner. Although the length of the developer roller 44 is equal to the width Wdr of the developer roller since the entire surface of the developer roller 44 carries toner according to this embodiment, if the developer roller is formed such that its entire surface does not carry toner, the actual length of the developer roller may not always be the same as the width Wdr of the developer roller. In summary, the respective members hold the relationship below:

$$Wpc > Wtb > Wcl > Wdr > Wim$$

As a result of this relationship in terms of size, the blade 763 of the cleaner 76 abuts on the surface of the intermediate transfer belt 71 even in areas outside the image forming region 71*a*. Inside the image forming region 71*a*, toner failing to get transferred to the sheet S in the secondary transfer region TR2 comes transported to the abutting section with the blade 763. In other words, since the efficiency of transferring a toner image from the intermediate transfer belt 71 to the sheet S is less than 100%, a part of toner forming the toner image carried on the intermediate transfer belt 71 will remain on the intermediate transfer belt 71. In addition, upon occurrence of a jam of the sheet S inside the apparatus on the path of the sheet transportation system, the blade 763 scrapes off a toner image which already is on the intermediate transfer belt 71 without any transfer of the toner image to the sheet. Such toner will stay between the intermediate transfer belt 71 and the blade 763 and serve to reduce friction.

However, there will rarely be such toner outside the image forming region 71*a*. Further, since the blade 763 abuts on and moves away from the intermediate transfer belt 71, toner accumulated at the tip of the blade 763 easily gets blown away and lost. In this area therefore, friction with the intermediate transfer belt 71 tends to intensify. Moreover, the edge of the blade 763 inherently tends to concentrate stress and give rise to curl, damage, etc.

In light of this, this embodiment requires forming end patch images which will be described later on the intermediate transfer belt 71 at predetermined timing which will be discussed later and scraping off the end patch images using the blade 763 to always accumulate toner at the edge of the blade 763.

Figure 6:
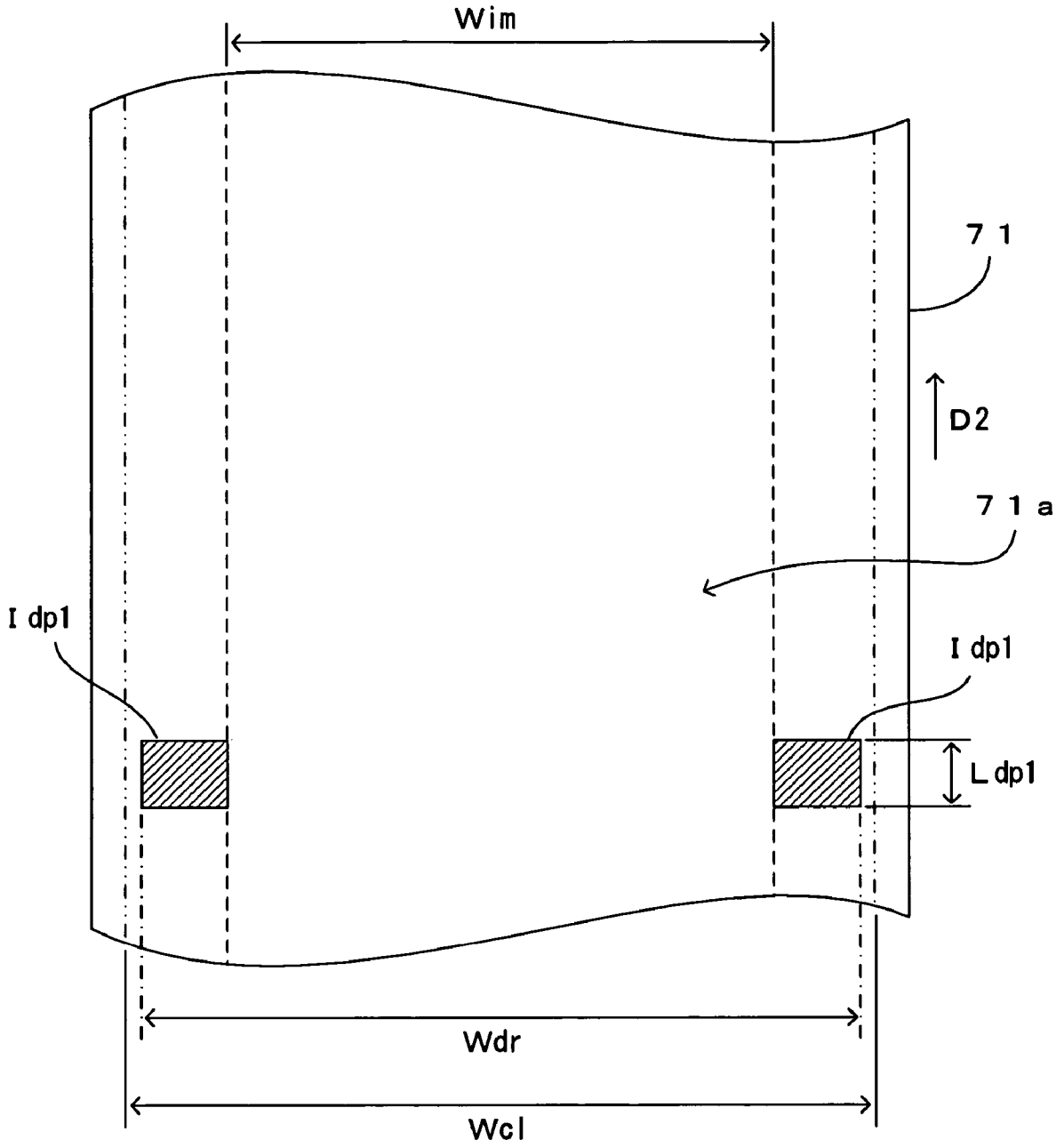
FIG. 6 is a drawing of a first example of end patch images.

FIG. 6 is a drawing of a first example of end patch images. The end patch images Idp1 are formed at the both ends of the surface of the intermediate transfer belt 71, more precisely, one at one location and the other at the other location in areas outside the image forming region 71*a* (hereinafter referred to as the "end areas") within the surface of the intermediate transfer belt 71 along the width direction which is orthogonal to the direction D2 in which the intermediate transfer belt 71 moves. Along the width direction, the inner edges of the end patch images Idp1 are at the boundaries between the image forming region 71*a* and the end areas (denoted at the dotted lines in FIG. 6). Meanwhile, the outer edges of the end patch images Idp1 extend as far as possible across a maximum area to which the developer roller 44 can make toner adhere (maximum development area, i.e., the area whose width is denoted at Wdr in FIG. 6).

While the image pattern and the length Ldp1 of the end patch images Idp1 may be freely decided, the following is preferable for example. The image pattern of the end patch image Idp1 is preferably a solid image or an equally dense image. This is to feed as much toner as possible to the tip of the blade 763 all at once and to ensure that a part of thus scraped toner spreads even beyond the width Wdr of the developer roller along the edge line of the blade 763 so that the toner will reach even to the end areas along the width direction of the blade 763. A solid image is the simplest such image pattern and can be formed easily. Meanwhile, as for the length Ldp1 of the end patch image Idp1, considering the balance with the image pattern, the length may be set so as to feed to the abutting section of the intermediate transfer belt 71 and the blade 763 a sufficient amount of toner necessary for toner accumulation at the blade 763.

Figure 7:
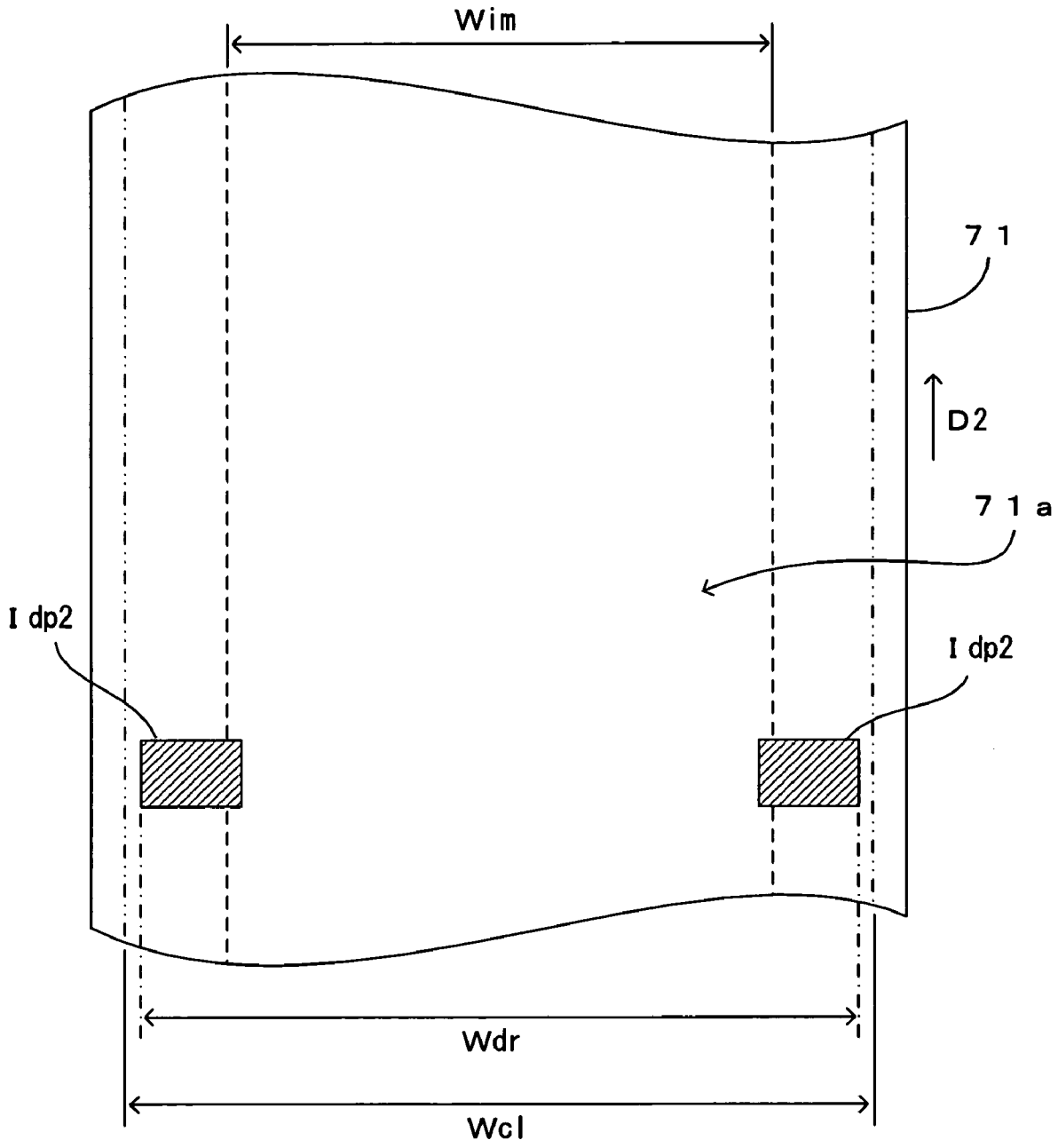
FIG. 7 is a drawing of a second example of end patch images.

FIG. 7 is a drawing of a second example of end patch images. The end patch images Idp2 according to the second example are different from those according to the first example in that they are partially over the image forming region 71*a*. End patch images are basically unnecessary for the image forming region as this region receives post-transfer leftover toner. When a certain good amount of toner is fed in as described above, a part of the toner spreads even to the sides along the edge line of the blade 763, and therefore, the inner edges of the end patch images may be somewhat outside relative to the outer ends of the image forming region 71*a* (the broken lines in FIG. 6). However, where the inner edges of the end patch images Idp2 are located inside the image forming region 71*a*, it is possible to prevent without fail creation of toner-starved areas at the boundaries between the image forming region and the end areas.

In the case of an apparatus which is structured so as to form images on multiple types of sheets whose sizes are different, the width of the image forming region becomes different between the different sheet sizes. The following may be exercised in such an apparatus, for example. First, end patch images are formed in accordance with the image forming region which corresponds to the smallest size. This prevents without fail creation of a toner-starved area between the intermediate transfer belt 71 and the blade 763 whichever size an actually formed image has.

Second, the most frequently used size among the sheet sizes is determined as a standard size, and end patch images are formed in accordance with the image forming region which corresponds to the standard size. Toner is highly likely to stay within the image forming region which corresponds to the standard size after transfer during image formation. Noting this, end patch images may be formed outside the image forming region, which accompanies no real risk of creating an area without any toner between the intermediate transfer belt 71 and the blade 763 and hence permits better reduce consumption of toner which is needed to form end patch images as compared with the first example described above.

Figure 8:
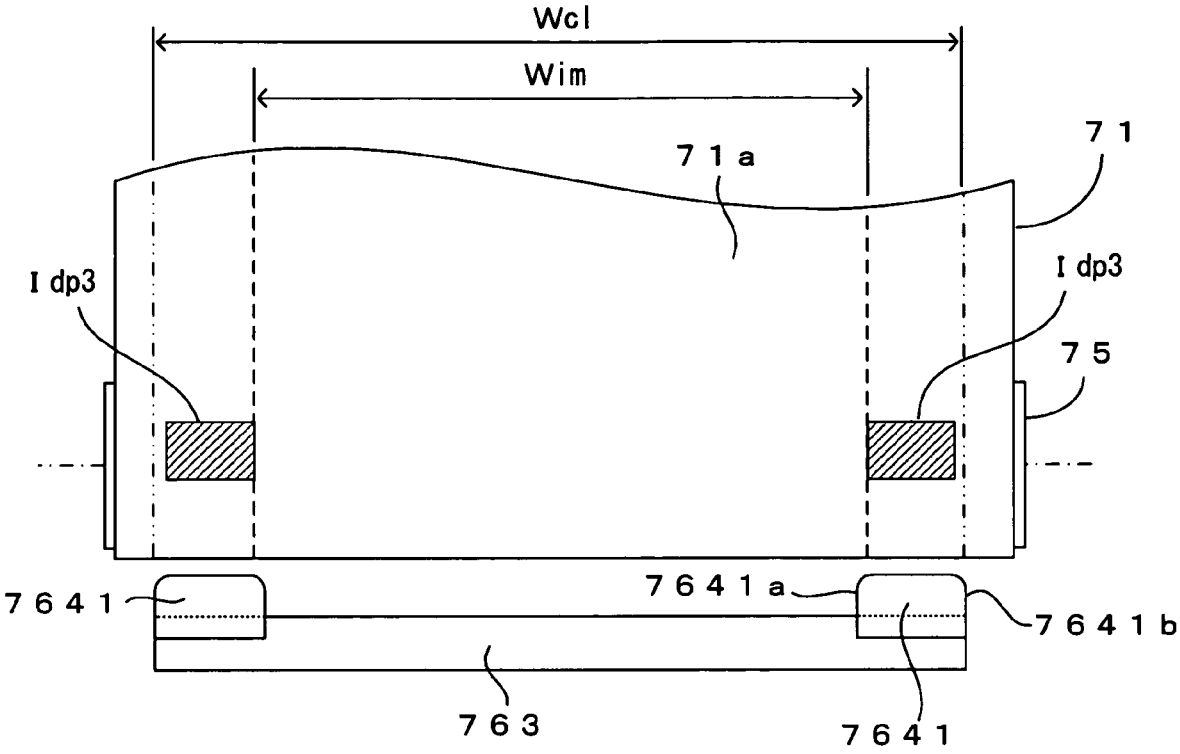
FIG. 8 is a drawing of modified toner stopper sheets.

FIG. 8 is a drawing of modified toner stopper sheets. According to the modified example in FIG. 8, toner stopper sheets 7641 are disposed only at the both ends of the blade 763. The inner edges 7641*a* of the toner stopper sheets 7641 are inward relative to the ends of the intermediate transfer belt 71 (broken lines). Meanwhile, the outer edges 7641*b* of the toner stopper sheets 7641 stretch out even to the ends of the blade 763. The reason of this design is as follows.

As described above, since the image forming region of the intermediate transfer belt 71 constantly receives a certain amount of residual toner as the image forming operation proceeds, an apparatus whose secondary transfer efficiency is not that high for instance may omit a toner stopper sheet for the image forming region and the abutting section with the blade 763. On the contrary, since arrival of residual toner can not be expected outside the image forming region and also since the ends of the blade 763 are likely to curl up, it is desirable to dispose a toner stopper sheet for prevention of curling up. The outer edges 7641*b* of the toner stopper sheets 7641 therefore preferably extend to at least the ends of the blade 763. Further, for supply of stored toner, the inner edges 7641*a* of the toner stopper sheets 7641 preferably extend to the ends of the image forming region, and more preferably, to inside the ends of the image forming region. This ensures that a part of residual toner scraped off inside the image forming region spreads even to outside the image forming region, and accordingly permits an effective use of such toner as a lubricant outside the image forming region.

In an apparatus having such a structure, end patch images Idp3 whose shapes are the same as those of the end patch images Idp1 which are shown in FIG. 6. Toner which the blade 763 scrapes off stays at the tip of the blade 763 due to the effect of the toner stopper sheets 7641. Even when the cleaner 76 is in its motion of abutting on and moving away from the belt, the toner stopper sheets 7641 prevent the toner from falling. Hence, there always is accumulated toner at the tip of the blade 763 and the ends of the blade 763 are prevented from curling up from this section. Further, inside the image forming region 71*a*, toner failing to get transferred to the sheet S is scraped off by the blade 763 and accumulates at the tip of the blade 763, which prevents the ends of the blade 763 from lapping in this section.

Figure 9:
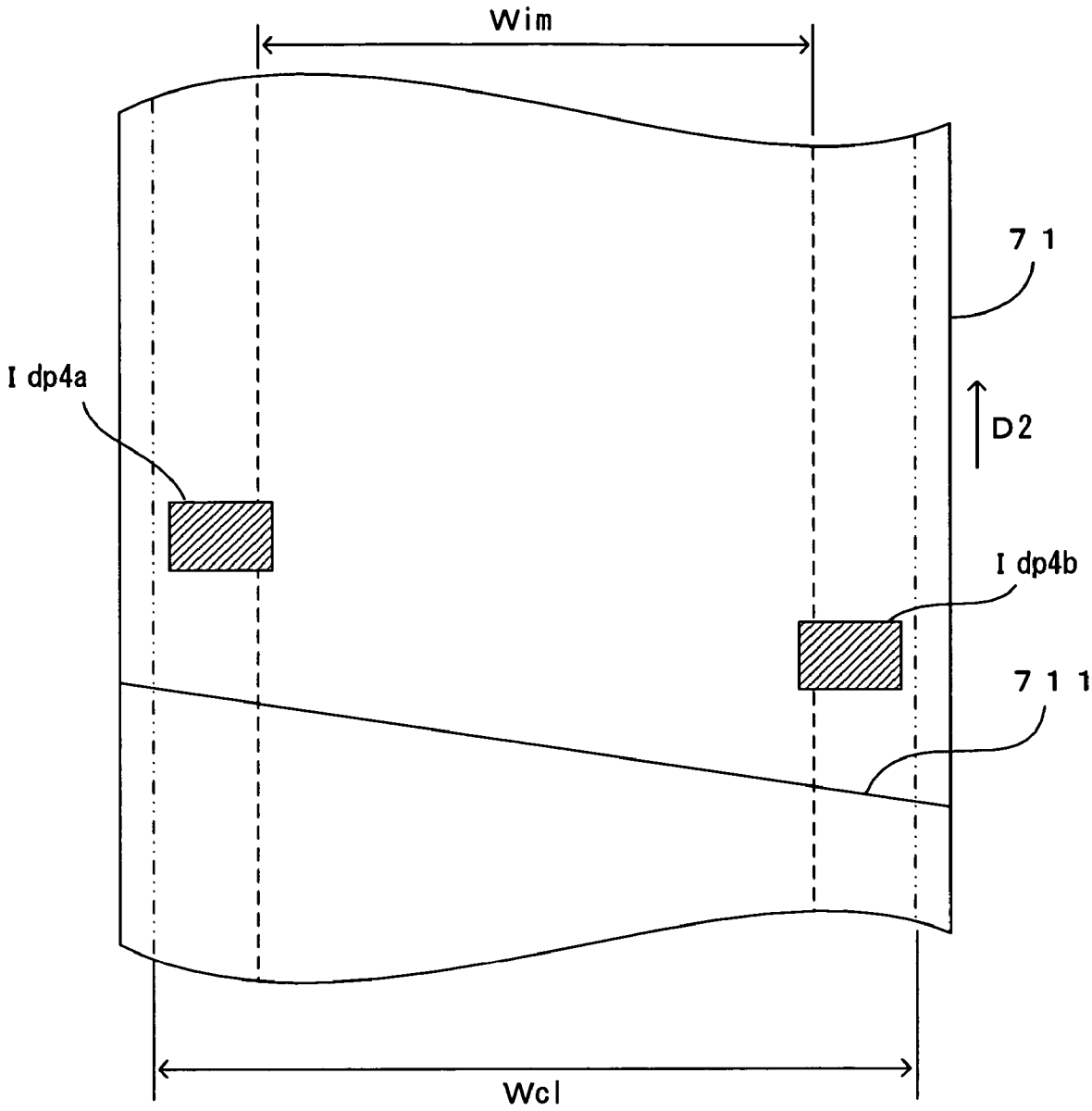
FIG. 9 is a drawing of a third example of end patch images.

FIG. 9 is a drawing of a third example of end patch images. The example in FIG. 9 is particularly effective in an apparatus comprising such an intermediate transfer belt 71 whose joint line is inclined with respect to the width direction of the belt. The intermediate transfer belt 71 is an endless belt. A method of manufacturing the belt may be one which requires protruding or otherwise appropriately forming the belt seamless from the beginning or one which requires joining a strip-shaped belt material at its two ends. The latter method is used widely since it allows forming a belt having a complex structure which combines materials having different functions. Belts having such joint lines include a belt whose joint line is inclined with respect to the width direction of the belt, as described in Japanese Unexamined Patent Application No. 2004-163503 for instance.

In an apparatus comprising an intermediate transfer belt having such a structure, as shown in FIG. 9, at the both ends of the intermediate transfer belt 71, end patch images Idp4*a* and Idp4*b* may be formed which are located at different positions along the travel direction D2 in accordance with the inclination of a joint line 711.

The timing of executing the toner accumulation processing in which the end patch images are formed will now be discussed below. In the image forming apparatus according to this embodiment, since the cleaning blade 763 which abuts on the intermediate transfer belt 71 seats the toner stopper sheet 764 or the toner stopper sheets 7641 which make toner accumulate at the tip of the blade 763, toner will not fall off from the tip of the blade 763 as described above. It is therefore possible to suppress low the frequency of the toner accumulation processing for re-supplying toner to the tip of the blade 763, and it is not necessary to form patch images every time images are formed on one sheet or plural sheets as in the apparatus according to Japanese Patent No. 3026035 described earlier in relation to "Related Art".

Further, with respect to end patch images on the intermediate transfer belt 71, since the end patch images need be transported to the abutting section with the blade 763 after moving passed the secondary transfer region TR2, secondary transfer must be avoided within the secondary transfer region TR2 while forming end patch images. This situation may be realized for instance by reversing the polarity of a secondary transfer bias or moving the secondary transfer roller 80 away from the intermediate transfer belt 71. Whichever is practiced, a different operation from the ordinary image forming operation is necessary, and hence, if the toner accumulation processing is built in the ordinary image forming operation, the image forming operation will be interrupted temporarily or become impossible during execution of the toner accumulation processing, thereby lowering the throughput of image formation.

In light of this, this embodiment requires executing the toner accumulation processing together with a density controlling operation which is executed at predetermined timing which may be right after power-on of the apparatus, upon recovery from sleeping, etc. The density controlling operation is processing of forming predetermined control patch images while varying density controlling factors influencing the densities of images over multiple stages and calculating optimal values of the density controlling factors which will bring the densities of images to a target density based on the detected densities of the control patch images. In this embodiment, the density controlling factors are the developing bias applied upon the developer roller 44 and the intensity of the exposure beam L which the exposure unit 6 irradiates toward the photosensitive member 22 (exposure power). The density controlling operation according to the embodiment will now be described.

Figure 10:
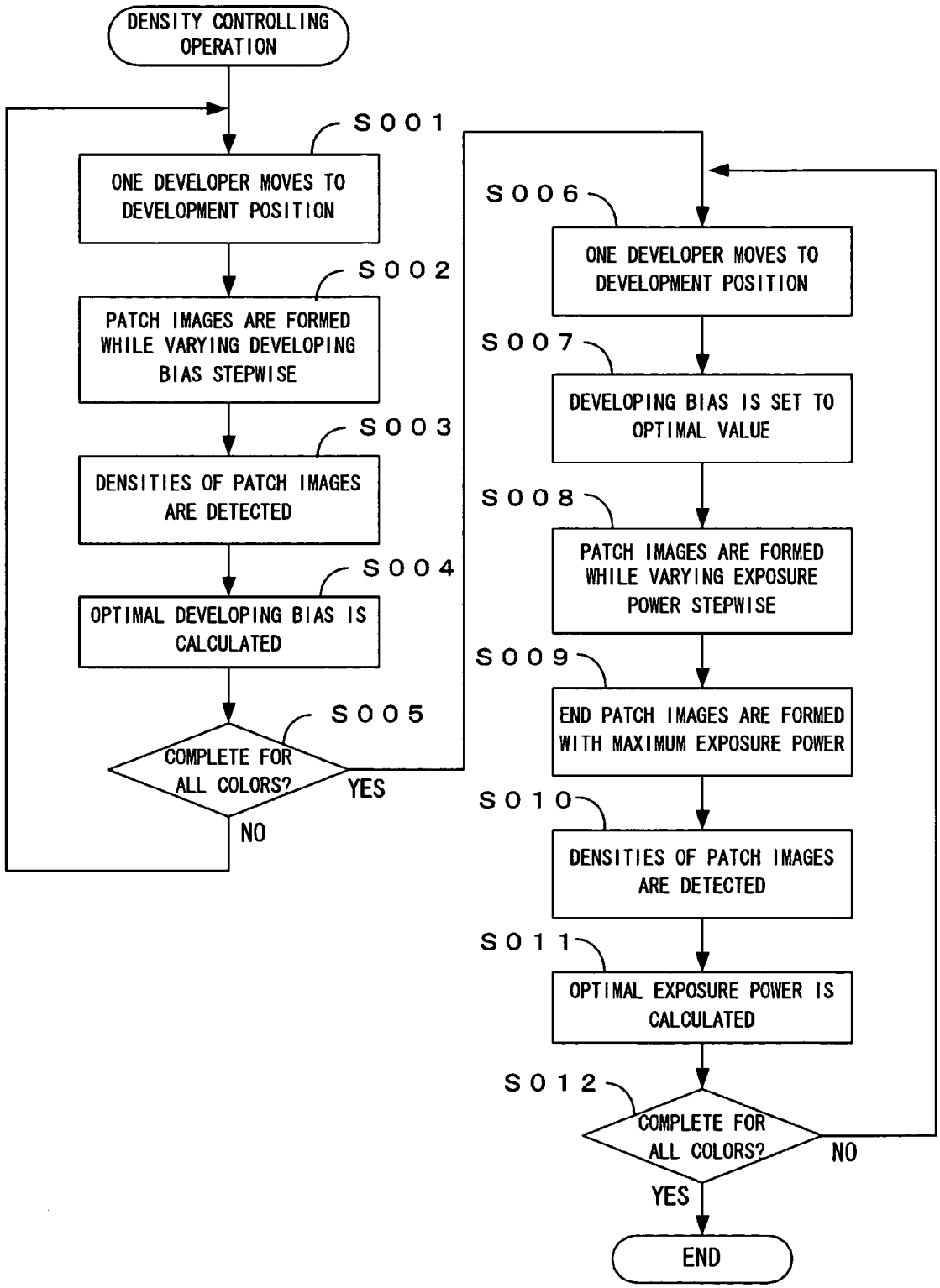
FIG. 10 is a flow chart of the density controlling operation according to the embodiment.

FIG. 10 is a flow chart of the density controlling operation according to the embodiment. First, the developing bias is optimized. One of the developers mounted to the developing unit 4 first moves to a development position which is opposed against the photosensitive member 22 (Step S001). While varying the developing bias applied upon this developer over multiple stages, predetermined control patch images (which may be solid images for instance) are then formed at the varying bias values (Step S002). As the intermediate transfer belt 71 moves, thus formed control patch images are transported to the opposed position against the density sensor 60 via the secondary transfer region TR2, and the density sensor 60 detects the densities of the respective patch images (Step S003). From the patch image densities detected in this fashion, an optimal value of the developing bias at which an image density will become a target density is calculated (Step S004). The processing from Step S001 through Step S004 is repeated using the respective developers until the processing has been completed for all colors (Step S005).

This is followed by optimization of the exposure power. One of the developers moves back to the development position (Step S006), the developing bias is set to the calculated optimal value (Step S007), and while varying the exposure power over multiple stages, predetermined control patch images (which may be halftone images for instance) are formed at the varying exposure power (Step S008). For prevention of an influence exerted by the past records remaining on the photosensitive member, the exposure power is changed from a small value to a large value gradually. Under the same image forming conditions as those for the last control patch image, namely, at the optimal developing bias and the maximum exposure power, end patch images are formed (Step S009).

In a similar manner to that for optimizing the developing bias, the densities of the respective patch images are detected (Step S010), and optimal exposure power is then calculated from the detected densities (Step S011). This series of processing (Step S006 through Step S011) is repeated until the processing has been completed for all colors (Step S012).

Figure 11:
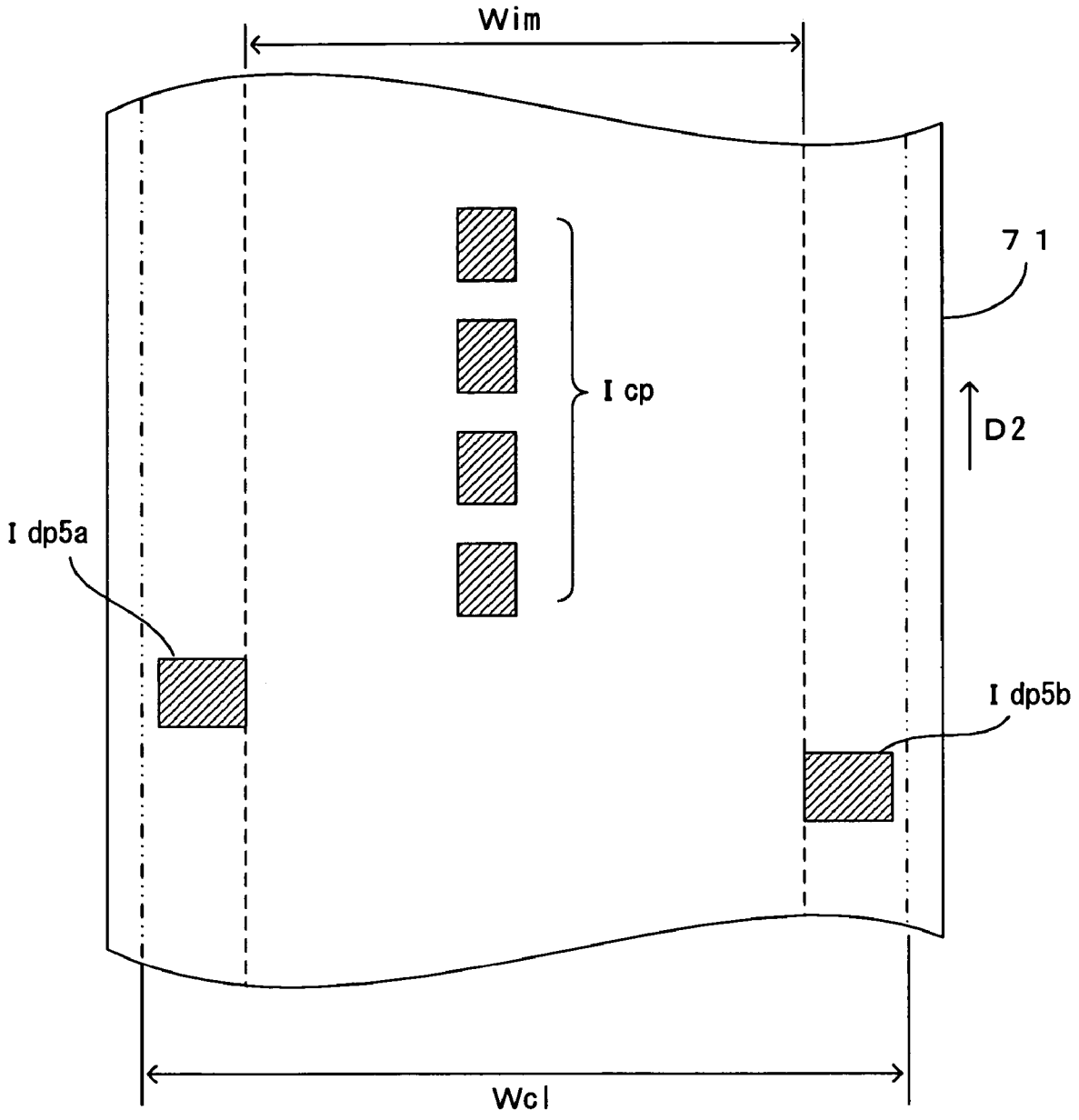
FIG. 11 is a drawing of patch images formed on the intermediate transfer belt.

FIG. 11 is a drawing of patch images formed on the intermediate transfer belt. Describing in more specific details, FIG. 11 is a drawing which shows the surface of the intermediate transfer belt 71 as it is when the density controlling operation above has finished Step S009. At this stage, the surface of the intermediate transfer belt 71 seats plural control patch images Icp formed while gradually raising the exposure power and end patch images Idp5*a* and Idp5*b* subsequently formed in the both end areas.

As described above, this embodiment requires forming the end patch images Idp5*a* and Idp5*b* at the same time that the patch images Icp are formed during the density controlling operation. This brings about the following benefits. First, while the apparatus is supposed to execute the image forming operation for the purpose of forming control patch images, end patch images as well are formed during the uninterrupted image forming operation and it is therefore not necessary to carry out a separate operation of forming the end patch images. This achieves easy control and shortens the processing time. As for the patch images Icp, they must be transported down to the downstream side moving passed the secondary transfer region TR2 so that their densities will be detected, and hence, the apparatus is set to such a state which makes this possible, namely, a state that secondary transfer will not take place. Describing this in more specific details, the secondary transfer roller 80 moves away from the surface of the intermediate transfer belt 71. End patch images, too, must move passed the secondary transfer region TR2 to reach the abutting section with the blade 763. In short, both control patch images and end patch images must move passed the secondary transfer region TR2 without any secondary transfer, which does not require changing the state of the apparatus as the both are formed at one time.

According to this embodiment, end patch images are formed at an optimized developing bias and with optimal exposure power. The reason of forming end patch images under these conditions is as follows. The objective of forming end patch images is to accumulate toner at the tip of the blade 763 by feeding a certain good amount of toner to the tip of the blade. From this perspective, it is necessary to properly control the amount of toner which form end patch images. In this relation, it is known that a developing bias is dominantly influential over the density of a solid image but the influence of exposure power is not significant. Hence, as an image forming condition for forming solid images or equally dense images as end patch images, at least the developing bias needs be set to an optimal value.

Meanwhile, although the exposure power needs not always be optimal, since too low exposure power could affect the density of a solid image, it is desirable to use relatively high exposure power. This embodiment therefore demands forming end patch images with the maximum exposure power. While forming end patch images with optimal exposure power is totally acceptable, doing this necessitates a procedure of forming control patch images, thereafter detecting the densities of the control patch images, then calculating the optimal exposure power, setting the exposure power to the calculated optimal value and finally forming end patch images, which processing takes a long time.

In this embodiment, for forming end patch images, the developing bias is set to an optimal value to thereby appropriately control image densities. Controlling the densities of end patch images stabilizes the amount of toner which is fed to the blade 763 and suppresses the lengths of the end patch images along the travel direction D2 of the intermediate transfer belt 71 to the minimum necessary lengths, and hence, suppresses a wasteful use of toner. With respect to the exposure power on the other hand, the end patch images are formed with the exposure power set to the maximum value instead of waiting for calculation of an optimal exposure power value to complete: That is, the end patch images are formed right after forming the control patch images Icp. Formation of the end patch images thus does not take up any extra time so that the processing time is short.

Further, this embodiment demands that each one of the multiple developers forms an end patch image. Although whichever their toner colors are, end patch images bring about approximately the same effects and forming end patch images at least in one toner color would be sufficient, forming end patch images each in each one of all toner colors as demanded by this embodiment achieves the following effects. First, as each developer supplies its toner accumulating at the blade 763, it is possible to avoid any particular developer from losing its toner faster than the others.

Further, it is ideal that the toner accumulates even at the outer-most ends of the blade 763, in which respect as well forming end patch images respectively by the multiple developers in the manner described above is effective. Owing to dimension differences between individual apparatuses, a backlash of the apparatus or the like, the relationship between the location of the photosensitive member 22 and that of the developer roller 44 at the development position is different between the developers, and due to these differences, the location of an end patch image formed on the intermediate transfer belt 71 becomes slightly different between the developers. Noting this, forming end patch images respectively by the multiple developers in the manner described above makes it possible to feed toner to a wider zone than where one developer is used.

As described above, this embodiment requires executing the toner accumulation processing of forming end patch images which aim at feeding toner to the end areas along the width direction of the blade 763 and scraping off the end patch images with the blade 763, while concurrently scraping off with the blade 763 residual toner which would remain within the image forming region 71*a* as the image forming operation proceeds. In consequence, toner accumulates all along the width of the blade 763 along the edge line of the tip of the blade 763, which reduces friction with the intermediate transfer belt 71. This securely prevents the ends of the blade 763 from curling up. Further, since patch images are formed only near the ends of the intermediate transfer belt, toner is consumed less and the running cost of the apparatus is low.

As for end patch images, since they are formed at the same time that control patch images are formed as a result of the density controlling operation, it is not necessary to perform another image forming operation solely for the sake of forming end patch images, thereby shortening the time needed for the processing. In addition, since end patch images are formed with the developing bias set to an optimal value and the exposure power set to the maximum value, the image densities of the end patch images are properly controlled, whereby the amount of toner stabilizes and the sizes of the end patch images become minimum necessary sizes. Further, since it is not necessary to wait for calculation of optimal exposure power to complete, the processing time is shortened further.

Further, since both control patch images and end patch images are such images which must move passed the secondary transfer region TR2, forming them all at one time does not necessitate any operation of changing the state of the apparatus (which is specifically the operation of the secondary transfer roller 80 abutting on and moving away).

As described above, in this embodiment, the photosensitive member 22, the rotary developing unit 4 and the intermediate transfer belt 71 function respectively as the "latent image carrier", the "developing unit" and the "intermediate transfer medium" of the invention. Meanwhile, the cleaner 76 functions as the "cleaner" of the invention. The blade 763 of the cleaner 76 serves as the "scraping member" of the invention, while the toner stopper sheets 764 and 7641 serve as the "toner reservoir member" of the invention. In addition, in this embodiment the engine controller 10 functions as the "controller" of the invention. The density sensor 60 and the exposure unit 6 in this embodiment function as the "density detector" and the "exposure unit" of the invention, respectively, in this embodiment.

The invention is not limited to the embodiment described above but may be modified in various manners in addition to the embodiment above, to the extent not deviating from the object of the invention. For instance, although the embodiment above requires that end patch images are all rectangular, the shapes of the end patch images are not limited to this but may be any desired shapes. Further, it is not essential that patch images formed at the both ends of the intermediate transfer belt 71 have the same shapes: They may be shaped differently. The image pattern is not limited to solid images described above either, but may instead be halftone images, line images, etc.

Although the end patch images Idp5*a* and Idp5*b* are formed one in front and the other in the back along the travel direction D2 of the intermediate transfer belt 71 in the example shown in FIG. 11, the locations of the images may be aligned to each other at the both ends as shown in FIG. 6.

Further, although the embodiment above requires executing the toner accumulation processing concurrently with execution of the density controlling operation, the density controlling operation is not always necessary in the invention. End patch images may be formed at a different time from the density controlling operation, in which case for prevention of a deteriorated throughput of image formation, it is preferable to execute the toner accumulation processing at different timing than the ongoing image forming operation. For example, the toner accumulation processing may be executed upon completion of an ongoing job after the number of sheets bearing formed images has exceeded a predetermined count.

Further, the invention is not applicable only to an apparatus which comprises a rotary developing unit as described above in relation to the embodiment, but may be applied generally to any image forming apparatus which comprises an intermediate transfer medium and a cleaner which abuts on the same and removes toner, including an image forming apparatus of the so-called tandem type and an image forming apparatus which forms an image utilizing other principle than the electrophotographic principle.

The image forming apparatus having the structure described above executes the toner accumulation processing concurrently with execution of the density controlling operation. Behind this practice is a premise that there already is a certain good amount of toner accumulated in the toner reservoir space SP from the beginning. This premise is not valid however immediately after a new transfer unit 7 has just been attached to the apparatus. Hence, when the transfer unit 7 is new, toner needs be fed into and accumulated within the toner reservoir space SP as early as possible. The following may be exercised to this end. That is, upon power-on of the apparatus, the CPU 101 executes start-up processing described below in accordance with a program stored in advance in the ROM 106, whereby the apparatus becomes ready to accept an image formation command from outside and form an image.

Figure 12:
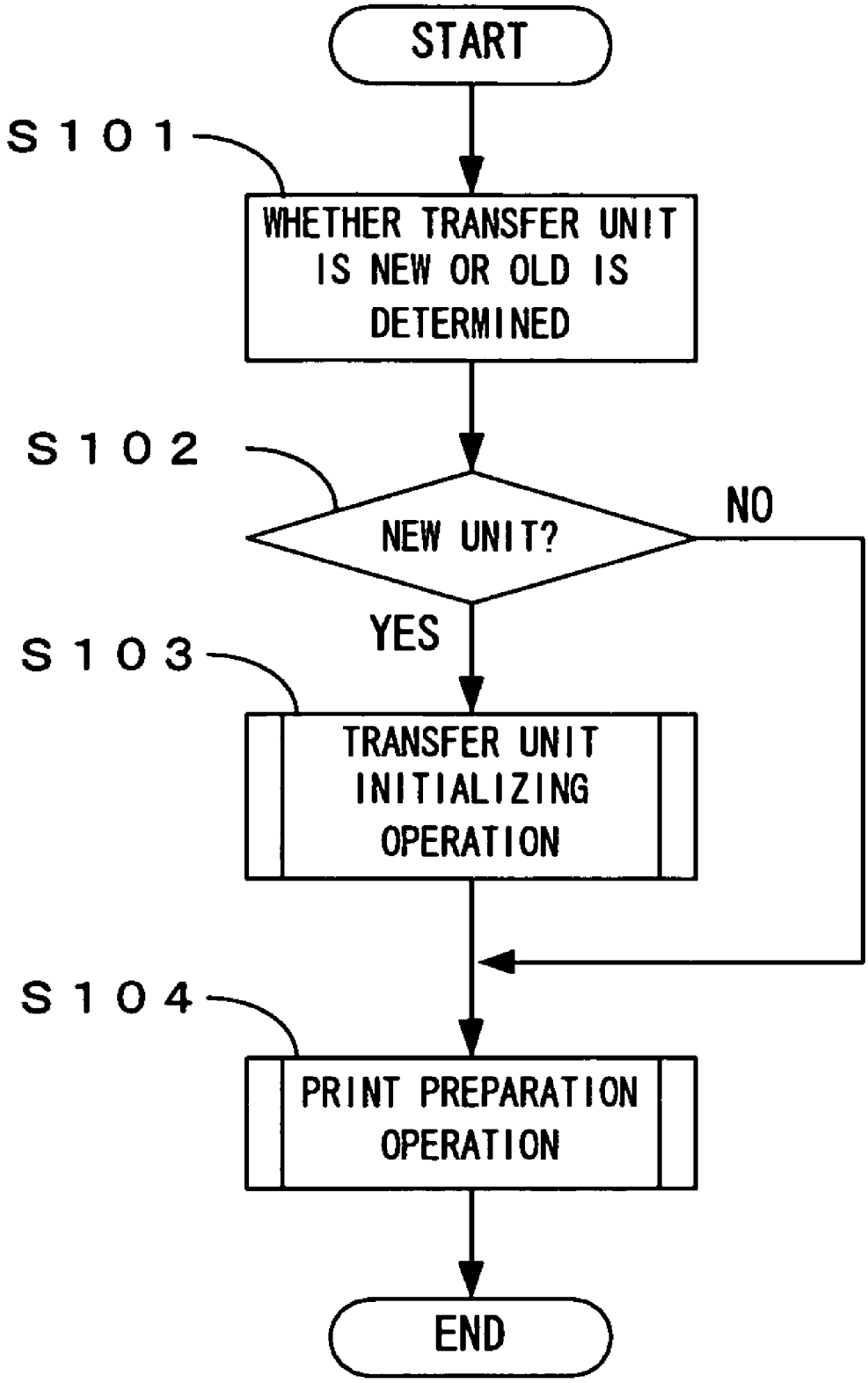
FIG. 12 is a flow chart of the start-up processing.

FIG. 12 is a flow chart of the start-up processing. Upon power-on of the apparatus, first, whether the transfer unit 7 is new or old is determined (Step S101). When the transfer unit 7 is found to be new one (Step S102), a transfer unit initializing operation (Step S103) and a print preparation operation (Step S104) are performed one after another. On the contrary, when the transfer unit 7 is not new, the print preparation operation alone is carried out, skipping the transfer unit initializing operation.

Whether the transfer unit 7 is new or old can be determined in the following manner for example. A fuse (not shown) is disposed to the transfer unit 7, while the main apparatus section is equipped with a current source (not shown) which is capable of supplying a sufficient current to blow the fuse. As a new transfer unit 7 is mounted and the apparatus is turned on, the current flows from the current source to the fuse and blows the fuse. Meanwhile, when the transfer unit 7 is not new, the fuse has already been blown off and will not carry the current. In other words, depending upon whether the current flows to the fuse upon power-on of the apparatus, whether the transfer unit 7 is new or old can be determined. An alternative is to equip the transfer unit 7 with a memory which stores information such as a serial number and a usage history and read out this information for determination of whether the transfer unit 7 is new or old.

Figure 13:
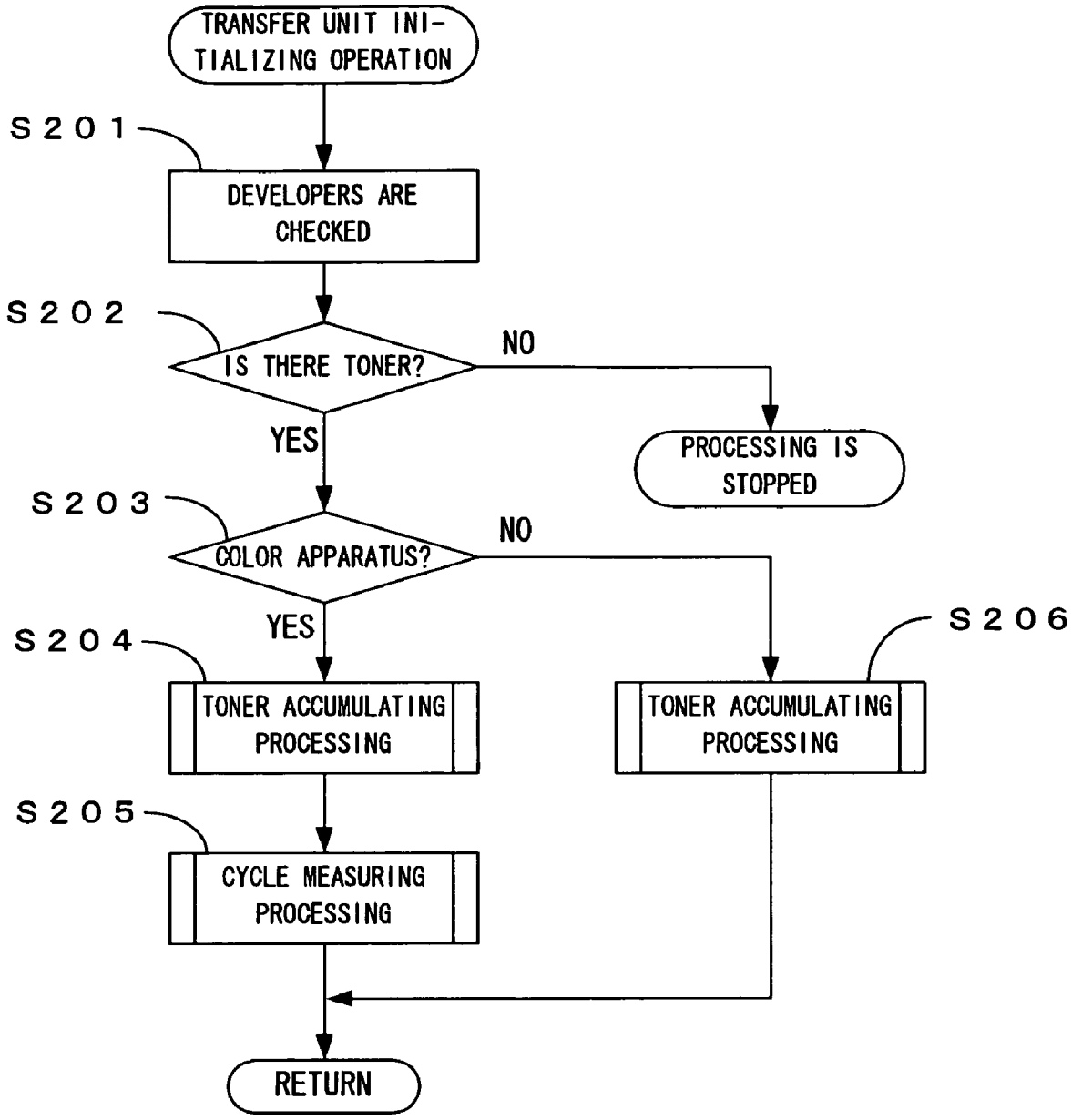
FIG. 13 is a flow chart of the transfer unit initializing operation.

FIG. 13 is a flow chart of the transfer unit initializing operation. First, the developers mounted to the developing unit 4 are checked (Step S201). This is a check of: (1) whether the developers are mounted at the four respective developer mounting positions set on the developing unit 4; (2) the toner colors in the respective developers; and (3) the remaining toner amount in each developer, all of which are found based on information stored in the memory disposed to each developer.

Following this, whether the remaining toner amount in a particular one of the developers is equal to or more than a predetermined amount is determined (Step S202). The "particular developer" herein referred to is the developer which is used to form a toner-accumulating toner image during the "toner accumulating processing" which will be described later. The particular developer may be designated in advance in accordance with a criterion such as the mounting position on the developing unit 4 or may be designated every time based on the result of the check described above. For instance, the developer for a particular color may be the "particular developer", or alternatively, one of the developers mounted to the developing unit 4 which has the greatest remaining toner amount may be designated as the "particular developer". However, since the content of the subsequent processing becomes different depending upon the remaining toner amount in the particular developer, it is preferable that the particular developer is the one which is expected to be used relatively heavily frequently. In the following, the black developer is the "particular developer".

When the remaining toner amount inside the particular developer is less than the predetermined amount, the start-up processing is stopped since the toner accumulating processing which will be described later can not be executed and since there is no hope to form an image of an excellent quality in this condition. In this instance, it is desirable to inform a user of the discontinuance of the processing due to the insufficient remaining toner amount.

On the contrary, when there is the predetermined amount of toner or more toner remaining inside the particular developer, whether the apparatus is used as a color image forming apparatus or a monochrome image forming apparatus is determined (Step S203). This is judged in this example in accordance with the number and the types of the developers mounted to the developing unit 4. In other words, when the developing unit 4 mounts the four developers for yellow, cyan, magenta and black, it is decided that the apparatus is used as a color image forming apparatus. In other instance, that is, there are not the developers for all of the four colors, it is decided that the apparatus is used as a monochrome image forming apparatus. Even when the developers for all of the four colors are mounted, a user's setting to use the apparatus as a dedicated monochrome image forming apparatus if any will supersede.

In the even that the apparatus is used as a color image forming apparatus, the toner accumulating processing (Step S204) and the cycle measuring processing (Step S205) which will be described below are executed in this order. On the contrary, when the apparatus is used as a monochrome image forming apparatus, the toner accumulating processing alone is executed (Step S206).

Figure 14:
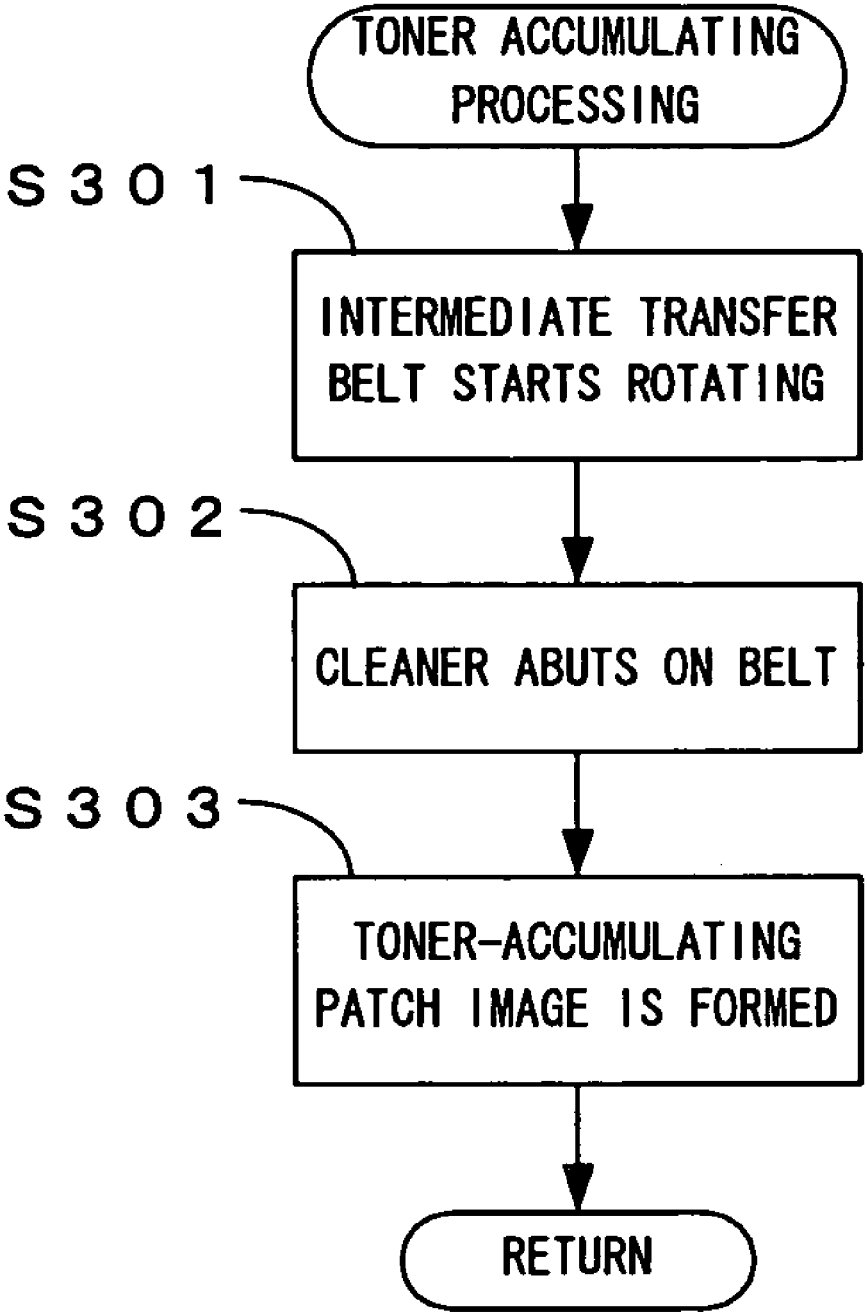
FIG. 14 is a flow chart of the toner accumulating processing.

FIG. 14 is a flow chart of the toner accumulating processing. The toner accumulating processing is processing of sending a constant amount of toner to the abutting section of the intermediate transfer belt 71 and the cleaning blade 763, making the toner function as a lubricant and accordingly reducing friction between the intermediate transfer belt 71 and the cleaning blade 763. As the intermediate transfer belt 71 is driven into rotations with the cleaning blade 763 abutting on the intermediate transfer belt 71, the two come to slide against each other while in mutual contact, which is likely to cause the curled ends of the cleaning blade 763, wear of the intermediate transfer belt 71, etc. Although a lubricant such as wax is applied to the tip of the blade before shipment in consideration of this, the lubrication effect will be gradually lost due to the contact. Further, during the continuous or intermittent image forming operation, toner remaining on the intermediate transfer belt 71 even after secondary transfer is fed to the abutting section with the blade 763 and functions as a lubricant. When the transfer unit 7 is new however, there is no such toner present, and hence, it is desirable to feed toner to the abutting section of the intermediate transfer belt 71 and the blade 763 as early as possible. The processing to this effect is the toner accumulating processing.

During the toner accumulating processing, first, the intermediate transfer belt 71 starts rotating (Step S301). Next, the blade 763 disposed to the cleaner 76 is urged against the surface of the intermediate transfer belt 71 (Step S302). At this stage, the wax applied to the tip of the blade functions as a lubricant. Following this, the engine part EG activates, whereby a toner-accumulating patch image Idp6 as that shown in FIG. 15 is formed on the intermediate transfer belt 71 (Step S303).

Figure 15:
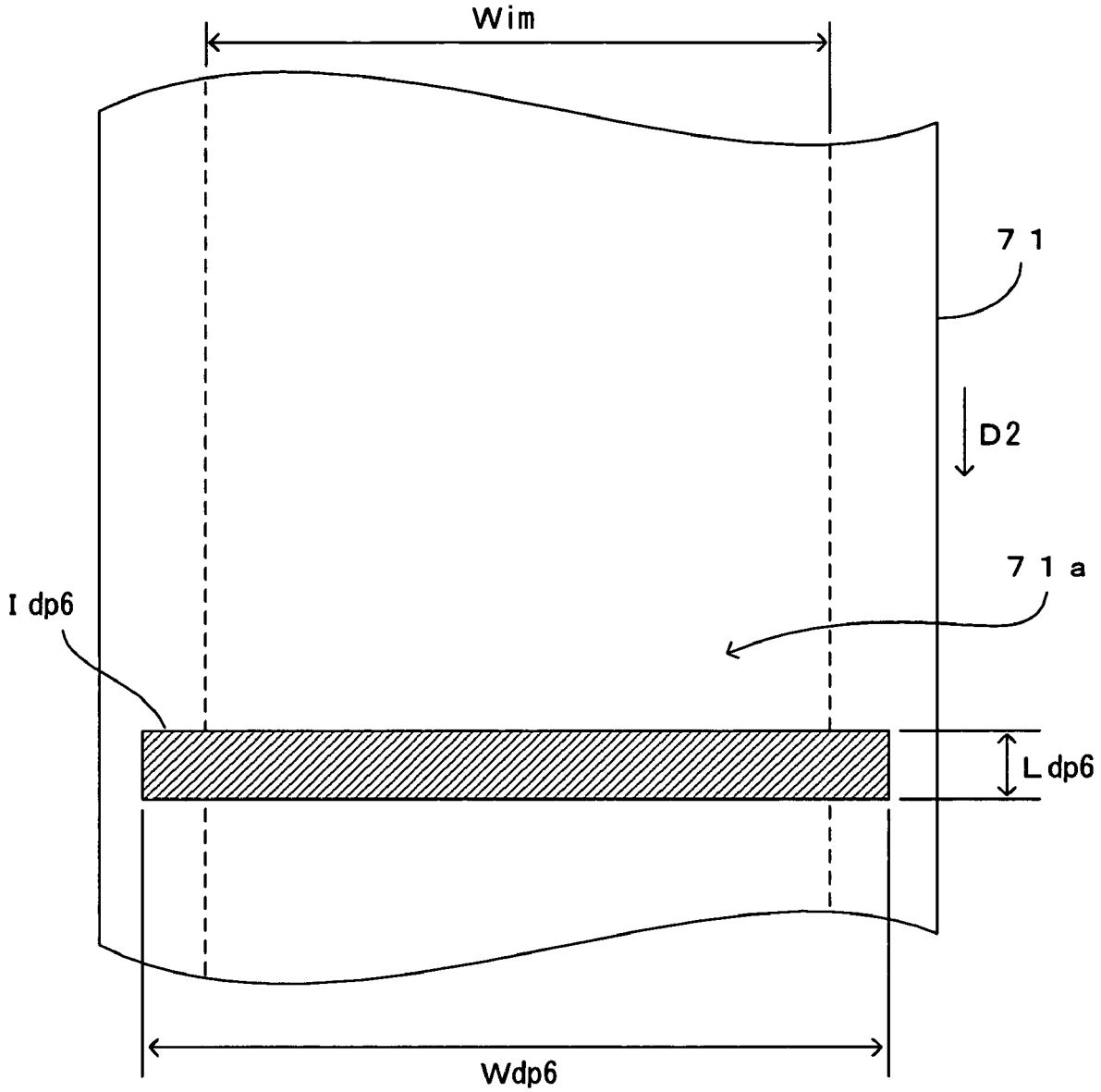
FIG. 15 is a drawing which shows one example of a toner-accumulating patch image.

FIG. 15 is a drawing which shows one example of a toner-accumulating patch image. The toner-accumulating patch image Idp6 is a stripe-like image extending along the width direction which is orthogonal to the travel direction D2 in which the intermediate transfer belt 71 moves, as shown in FIG. 15. The image pattern of the toner-accumulating patch image may be any desired pattern, to make it easy to form the toner-accumulating patch image, the toner-accumulating patch image may be a solid image or a halftone image for instance. The length Ldp6 of the toner-accumulating patch image Idp6 taken along the travel direction D2 of the intermediate transfer belt 71 is such a length which is necessary to supply to the abutting section with the blade 763 a sufficient amount of toner which will accumulate in the toner reservoir space SP.

The width Wdp6 of the toner-accumulating patch image Idp6 is as described below. For prevention of wear of the intermediate transfer belt 71, the curled ends of the blade 763 and the like, toner needs to accumulate all along the width of the blade 763. Hence, the width Wdp6 of the toner-accumulating patch image Idp6 is preferably wider than the width Wim of the image forming region, and if possible, about the same as the width Wcl of the blade (FIG. 4). However, since the cleaner 76 can not remove toner adhering to the intermediate transfer belt 71 outside the blade's width, the width Wdp6 of the toner-accumulating patch image Idp6 must not exceed the width Wcl of the blade. It is also expected that a part of scraped toner will spread outside the width of the toner-accumulating patch image within the toner reservoir space SP. The width Wdp6 of the toner-accumulating patch image Idp6 is therefore preferably wider than the width Wim of the image forming region but slightly narrower than the width Wcl of the blade.

As the blade 763 abutting on the intermediate transfer belt 71 scrapes off such a toner-accumulating patch image Idp6, toner accumulates in the toner reservoir space SP which is at the tip of the blade 763, which attains a function that the accumulated toner effectively protects the intermediate transfer belt 71 and the blade 763 against damage, wear and the like.

Figure 16:
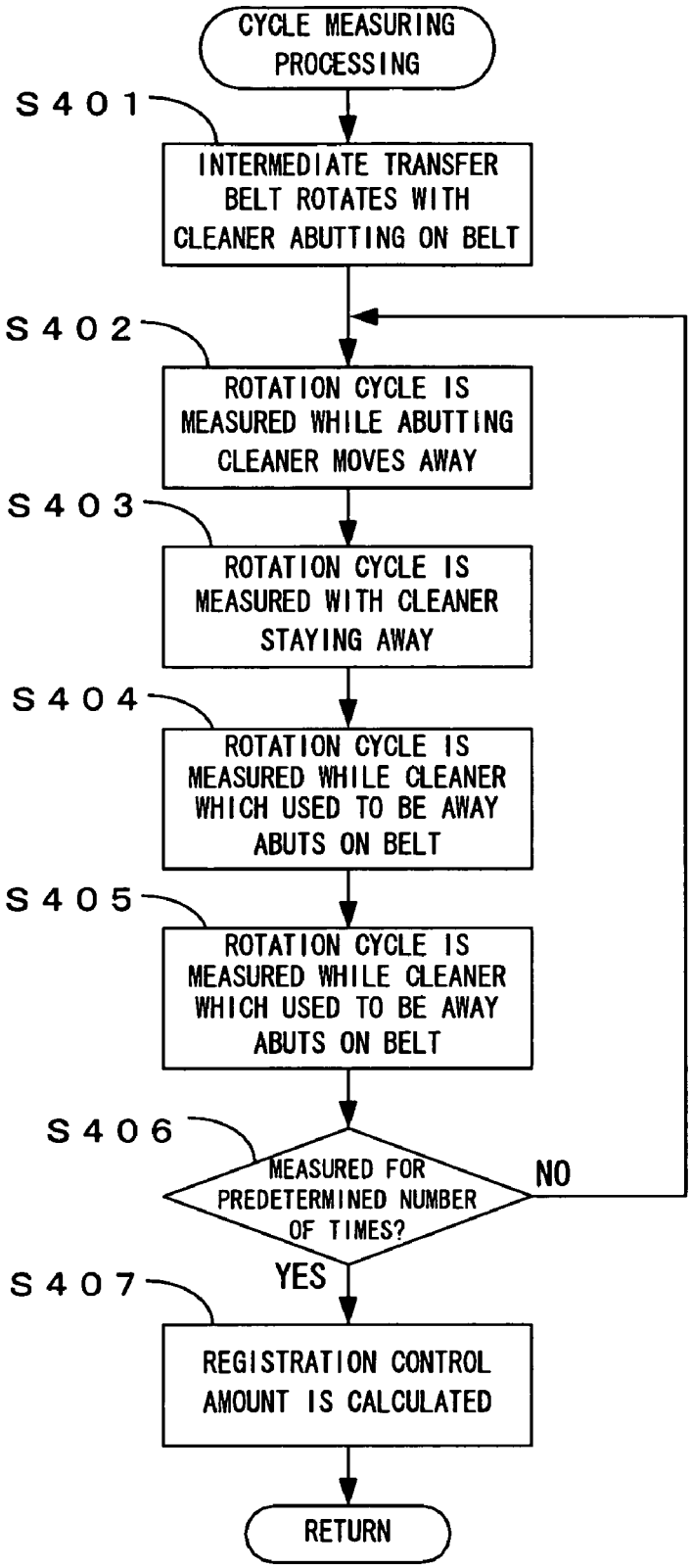
FIG. 16 is a drawing of the cycle measuring processing for the intermediate transfer belt.
Figure 17:
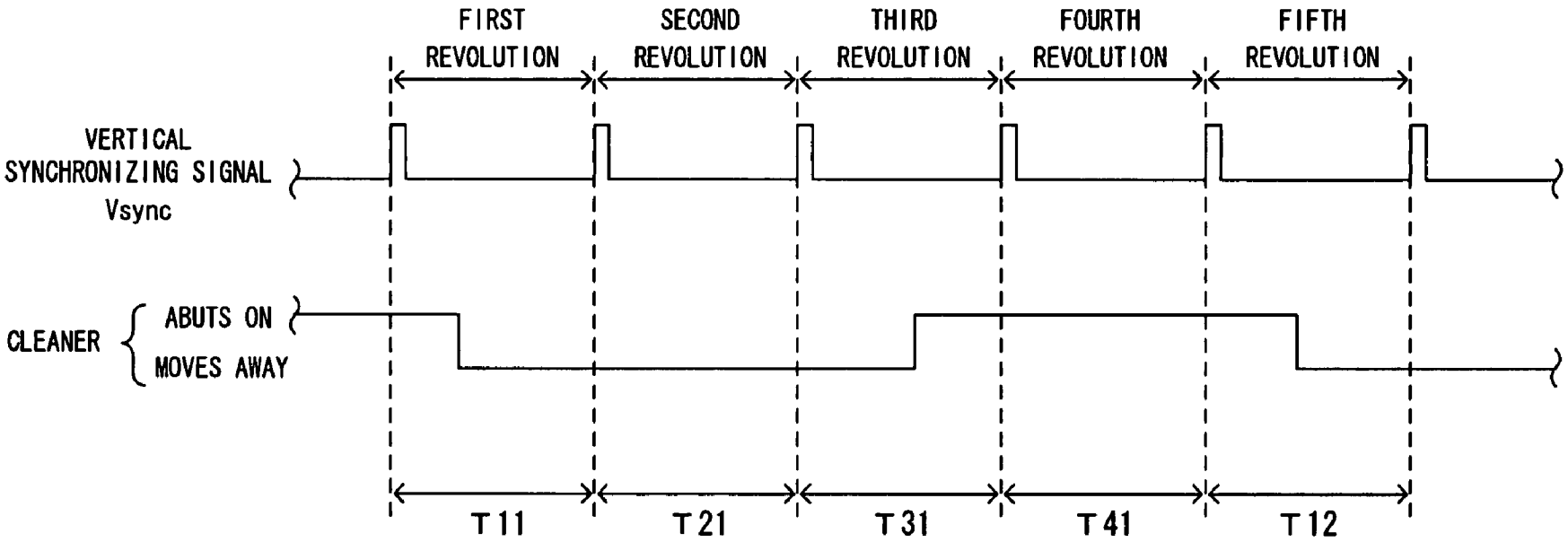
FIG. 17 is a timing chart which shows the principle of cycle measurement.

FIG. 16 is a drawing of the cycle measuring processing for the intermediate transfer belt. FIG. 17 is a timing chart which shows the principle of cycle measurement. During the cycle measuring processing, the intermediate transfer belt 71 rotates with the cleaning blade 763 abutting on the intermediate transfer belt 71 (Step S401). The rotation cycle of the intermediate transfer belt 71 is measured every time the intermediate transfer belt 71 makes a revolution. During the first revolution, the abutting blade 763 is made to move away and the rotation cycle T11 under that circumstance is measured (Step S402). The rotation cycle of the intermediate transfer belt 71 can be calculated as the rising cycle of the vertical synchronizing signal Vsync which the vertical synchronization sensor 77 outputs in synchronization to the rotation of the intermediate transfer belt 71. During the next revolution, the rotation cycle T21 is measured while keeping the blade staying away (Step S403). During the third revolution, the abutting blade 763 is made to abut on the intermediate transfer belt 71 and the rotation cycle T31 under that circumstance is measured (Step S404). During the fourth revolution, the rotation cycle T41 is measured while keeping the blade abutting (Step S405). Treating these four revolutions as one set, cycle measurement is repeated for a predetermined number of times, e.g., for ten sets (Step S406).

From thus measured rotation cycles, the registration control amount for color image formation is calculated (Step S407). The registration control amount herein referred to is the amount by which a transfer start position shifts during primary transfer of a toner image onto the intermediate transfer belt 71 from the photosensitive member 22. The rotation cycle of the intermediate transfer belt 71 changes when the belt stretches or shrinks as the blade 763 abuts on and moves away from the belt and also when a load upon the motor changes. The rotation cycle T41, i.e., a rotation cycle during a revolution with the blade 763 abutting on the belt typically tends to be longer than the rotation cycle T21 which is a rotation cycle during a revolution with the blade 763 staying away from the belt. Further, the rotation cycles T11 and T31 which are cycles during revolutions in the middle of which the blade 763 moves away from the belt or abuts on the belt are longer than the rotation cycle T21 but shorter than the rotation cycle T41. From this measurement result, it is possible to estimate the extent to which the rotation speed of the intermediate transfer belt 71 will change when the blade 763 abuts on the same. In this embodiment, in an attempt to reduce an error in measuring the rotation cycles of the intermediate transfer belt 71 and enhance the accuracy of registration control, the cycles are measured in the different abutting conditions for multiple times (ten times in the example above), and from an average value of the measurement values (the cycle T11 during the first revolution, the cycle T12 during the fifth revolution, . . . as for the revolutions during which the blade moves away for instance), the registration control amount is calculated.

The varying rotation speed of the intermediate transfer belt 71 deviates a toner image from its position (registration error) and eventually leads to deterioration of the image quality. Noting this, while forming toner images in the respective colors, depending upon how the blade 763 abuts on the intermediate transfer belt 71 while a toner image is being formed, the transfer start position of the toner image is adjusted, which in turn makes it possible to prevent such deviation and form a color image which has an excellent image quality. There are known techniques available as for a specific method for registration control. The technique described in Japanese Unexamined Patent Application No. 2001-235924 for instance is applicable to this embodiment, and therefore, the method will not be described in detail here.

Measurement of the rotation cycles of the intermediate transfer belt 71 described above follows the toner accumulating processing as shown in FIG. 13. Hence, by the time the rotation cycle is measured, there already is accumulated toner in the abutting section where the intermediate transfer belt 71 and the blade 763 abut on each other. This not only prevents the curled ends of the blade 763 and wear of the intermediate transfer belt 71 during execution of the cycle measuring processing but also contributes to improvement of the accuracy of registration control. This is because it is possible to calculate the rotation cycles of the intermediate transfer belt 71 in a state which resembles the state during the actual image forming operation when the cycles are measured with toner accumulated at the tip of the blade. But for the toner accumulating processing performed in advance, measurement will take place under a different condition from that for the actual image forming operation and the accuracy of registration control will deteriorate. This remains true even if wax or the like has been applied to the blade in advance.

When the apparatus is used as a monochrome image forming apparatus, superimposition of toner images on the intermediate transfer belt 71 is not performed, and hence, it is not necessary to execute registration control and the cycle measuring processing which serves as preparation for registration control. Where the apparatus is used as a monochrome image forming apparatus therefore, the cycle measuring processing may be omitted to significantly shorten the processing time.

Figure 18:
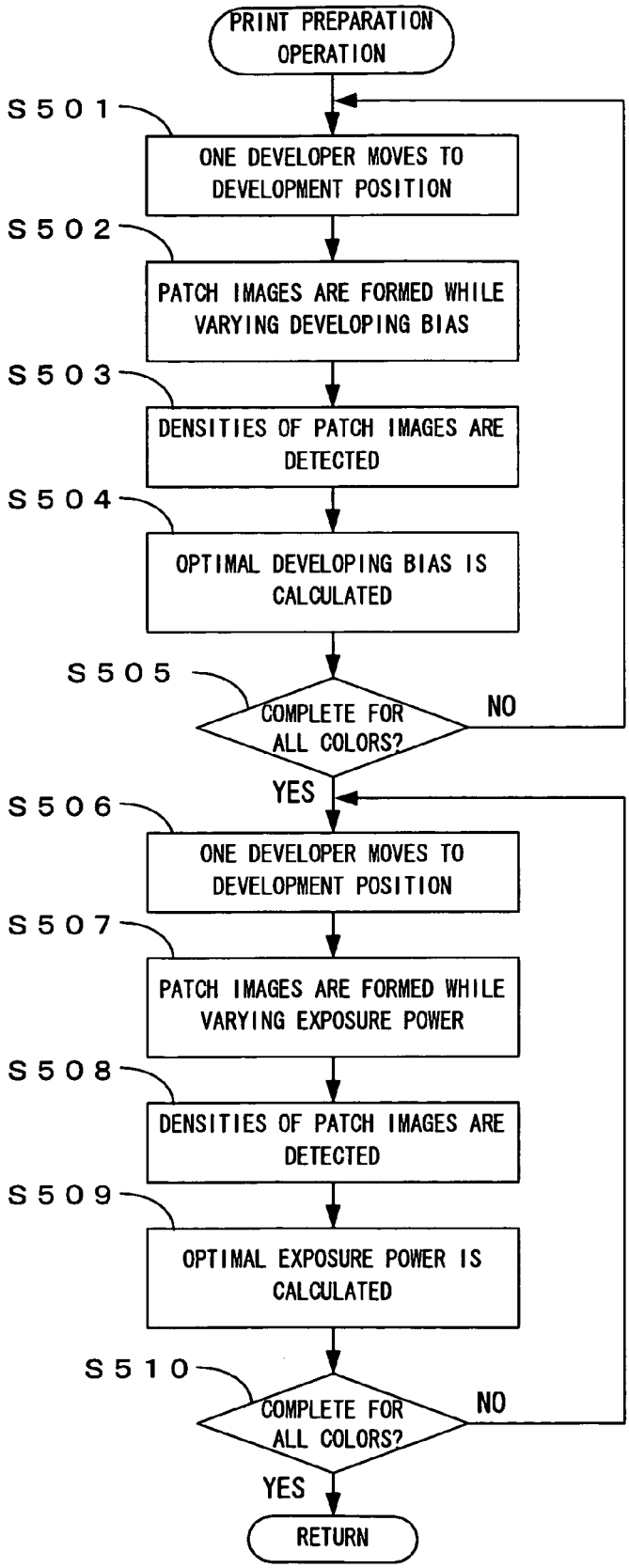
FIG. 18 is a flow chart of the print preparation operation.

FIG. 18 is a flow chart of the print preparation operation. This operation is adjustment of operation parameters which influence the quality of an image, for the purpose of maintaining a predetermined image quality. The operation parameters used in this embodiment are the developing bias and the exposure power described earlier. Based on the detected densities of toner images formed as patch images, these parameters are optimized. Parameters which influence the quality of an image and a method of adjusting the parameters are known according to many other conventional techniques besides what is described here. As those conventional techniques are applicable also to this embodiment, the flow of the processing alone will now be briefly described. Further, although omitted in FIG. 18, a warming-up operation of heating the fixing unit 9 to a predetermined fixing temperature is performed concurrently with parameter optimization.

The print preparation operation starts first with optimization of the developing bias (Step S501 through Step S505). Describing this in more specific details, first, one developer moves to the development position which is opposed against the photosensitive member 22 (Step S501). While varying the developing bias applied upon this developer over multiple stages, predetermined patch images are formed at the varying bias values (Step S502). The density sensor 60 detects the densities of these patch images transferred onto the intermediate transfer belt 71 (Step S503), and from the result of the measurement, an optimal value of the developing bias at which a patch image density will become a target density is calculated (Step S504). The series of processing is repeated until the processing has been completed for all necessary developers (Step S505). For a color image forming apparatus, the optimal developing biases must be calculated on the developers for all of the four colors. Meanwhile, in the case of a monochrome image forming apparatus, this processing is not always necessary for all developers. Optimization for at least one developer makes it possible to form a monochrome image.

This is followed by optimization of the exposure power for exposure of the photosensitive member 22 using the exposure unit 6 (Step S506 through Step S510). First, one developer moves to the development position which is opposed against the photosensitive member 22 (Step S506). While varying the exposure power available from the exposure unit 6, predetermined patch images are formed at the varying levels of power (Step S507). At this stage, the developing bias is set to the calculated optimal value. In a similar fashion to the above, the density sensor 60 detects the densities of these patch images (Step S508), and an optimal value of the exposure power is calculated from the result of the measurement (Step S509). The series of processing is repeated until the processing has been completed for all necessary developers (Step S510).

This optimizes the developing bias and the exposure power for each developer to be used to form images. In the subsequent image forming operation, with the developing bias and the exposure power set to thus calculated optimal values, it is possible to stably form an image having an excellent quality.

As described above, in this embodiment, when the transfer unit 7 is new including the intermediate transfer belt 71 and the cleaner 76, the initializing operation of making the transfer unit 7 ready for use is performed. In this case, depending upon whether the apparatus is used as a color image forming apparatus or a monochrome image forming apparatus at the time of execution of the initializing operation, the content of the initializing operation becomes different. More specifically, the initializing operation for a color image forming apparatus involves execution of the toner accumulating processing and the cycle measuring processing in this order, which is further followed by the print preparation operation. Meanwhile, for a monochrome image forming apparatus, the print preparation operation is executed after the initializing operation which includes the toner accumulating processing but does not include the cycle measuring processing. Changing the content of the initializing operation in this manner in accordance with whether the apparatus is used for colors or monochrome permits executing the initializing operation which is suitable to the operating state of the apparatus and making the initializing operation more efficient as compared with where the conventional techniques are used which require execution of the initializing operation having an inflexible content.

The toner accumulating processing is achieved as a stripe-like image extending along the width direction which is orthogonal to the travel direction D2 of the intermediate transfer belt 71 is formed and the blade 763 scrapes off this image. Hence, no special structure for toner accumulation is necessary. In addition, since the toner accumulating processing is executed prior to any other operation when the transfer unit 7 is new, the intermediate transfer belt 71 and the blade 763 will not slide against each other in contact with great friction, thereby effectively suppressing wear, damage and the like of the intermediate transfer belt 71 and the cleaner 76.

Registration control according to this embodiment requires individually measuring the rotation cycle during each revolution while changing how the blade 763 abuts on the intermediate transfer belt 71 to the four states (with the blade which used to abut on the belt moving away from the belt, with the blade kept away, with the blade which used to stay away becoming abutting on the belt, and with the blade kept abutting on the belt) and calculating the registration control amount from the result of the measurement. Hence, it is possible to superimpose toner images at a high accuracy.

While the cycle measuring processing is executed when the transfer unit 7 is new, the cycles are measured in a condition that there is accumulated toner in the abutting section where the intermediate transfer belt 71 and the blade 763 abut on each other. This achieves measurement in a state which resembles the state during the actual image forming operation, which further improves the accuracy of registration control. Further, while the blade 763 abuts on and moves away from the intermediate transfer belt 71 repeatedly during the cycle measuring processing and this tends to result in the curled ends of the blade 763, toner accumulated in advance significantly reduces that risk.

A special occasion will now be described that the initializing operation for the transfer unit 7 is executed while the apparatus is used as a monochrome image forming apparatus and the apparatus is then switched to a color image forming apparatus. The use condition of the apparatus is switched as the developers are replaced after the end of the initializing operation for example. While the apparatus is switched to a color image forming apparatus in this manner, forming a color image immediately in this condition is not proper. This is because the cycle of the intermediate transfer belt 71 needed for registration control has not been performed yet. Hence, the cycle measuring processing needs be executed before forming an image in the event that the apparatus is switched from a monochrome image forming apparatus to a color image forming apparatus but the cycle measuring processing using the current transfer unit 7 has not been performed yet.

The cycle measuring processing may be executed in the following two manners for example. The first way is to execute exactly the same initializing operation as that for a new transfer unit 7 after the apparatus has been switched to a color image forming apparatus. In other words, the transfer unit initializing operation as that shown in FIG. 13 is executed after the apparatus is switched to a color image forming apparatus, thereby performing the toner accumulating processing and the cycle measuring processing. This processing can be realized by changing the condition that "the transfer unit is new" for commencing the transfer unit initializing operation during the start-up processing shown in FIG. 12 to a condition that "the transfer unit is new or the apparatus is newly switched to a color image forming apparatus".

The second way is to execute the cycle measuring processing while skipping the toner accumulating processing. When the apparatus is switched to a color image forming apparatus during its use, it is generally considered that the transfer unit 7 is not new and that there already is a certain amount of accumulated toner on the blade 763, and therefore, the toner accumulating processing may be omitted under this circumstance to thereby shorten the processing time and save toner.

In any event, when the apparatus is switched from monochrome to colors, it is desirable to perform the cycle measuring processing before forming a color image and reflect the result in registration control so that it will be possible to achieve more accurate registration control and form an image of an excellent quality. In the event that the transfer unit 7 is found to be new one and the apparatus is used as a monochrome image forming apparatus due to user's setting although the developers for all of the four colors are mounted, the cycle measuring processing may be executed at that time or later when the cycle measuring processing becomes necessary (i.e., when user's setting requires a change to colors). In the former situation, it is possible to form a color image right after a change to user's setting. In the latter situation, it is possible to shorten the time needed for the start-up processing for a new transfer unit.

As described above, in this embodiment, the intermediate transfer belt 71 and the cleaner 76 function as the "image carrier" and the "cleaner" respectively of the invention. The photosensitive member 22, the exposure unit 6, the developing unit 4 and the like altogether as one function as the "image forming unit" of the invention. Further, the engine controller 10 functions as the "controller" of the invention.

The invention is not limited to the embodiment described above but may be modified in various manners in addition to the embodiment above, to the extent not deviating from the object of the invention. For instance, although the embodiment above requires the print preparation operation following the transfer unit initializing operation, the print preparation operation is not indispensable in the invention. The print preparation operation may therefore be omitted or other processing operation may be appropriately added before or after initialization of the transfer unit.

Further, although the embodiment above requires judging whether the transfer unit is new or old only right after power-on of the apparatus, this is not limiting. Whether the transfer unit is new may be determined all times for instance. However, if the unit is replaced only while the power is off, judging whether the transfer unit is new only upon power-on as in the embodiment above would be sufficient.

Further, although the transfer unit 7 is structured such that the intermediate transfer belt 71 and the cleaner 76 can be attached to and detached from the main apparatus section as one unit according to the embodiment above, the unit may be structured such that the intermediate transfer belt and the cleaner are separate from each other, in which case the toner accumulating processing should be executed when either at least one of the intermediate transfer belt and the cleaner is new. Meanwhile, the cycle measuring processing should be executed when at least the intermediate transfer belt is new.

Further, although the embodiment above is directed to an image forming apparatus whose intermediate transfer belt serves as an image carrier, the invention is applicable also to other apparatus which comprises a different image carrier which may for example be a drum-shaped image carrier. Alternatively, a photosensitive member may serve as the "image carrier" in implementing the invention. Particularly in an apparatus having a structure that the position on a photosensitive member at which an image is formed is adjusted for registration control, treating the photosensitive member as the "image carrier" of the invention achieves similar effects to those described above.

Further, the invention is applicable not only to an apparatus comprising a rotary developing unit as that according to the embodiment above but is generally applicable also to an image forming apparatus of the so-called tandem type and even an image forming apparatus which forms an image utilizing other principle than the electrophotographic principle but which comprises an image carrier temporarily carrying a toner image and a cleaner abutting on the image carrier and removing toner.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus, comprising:

a latent image carrier which carries an electrostatic latent image;

a developing unit which visualizes with toner the electrostatic latent image carried by the latent image carrier and forms a toner image;

an intermediate transfer medium to which the toner image is transferred from the latent image carrier and which rotates and transports the toner image to a predetermined transfer position and transfers the toner image to a recording medium;

a cleaner which abuts on the surface of the intermediate transfer medium and removes toner which adheres to the surface of the intermediate transfer medium after the transfer to the recording medium; and a controller which, assuming that the direction which is orthogonal to the travel direction in which the intermediate transfer medium moves is a width direction, executes toner accumulating processing during which predetermined toner images are formed as end patch images in end areas of the surface of the intermediate transfer medium which are located on outer side along the width direction relative to an image forming region in which a toner image corresponding to size of the recording medium is formed and the cleaner then removes the end patch images, wherein the cleaner includes a blade-like scraping member which extends along the width direction, has a wider width than the width of the image forming region, abuts on the intermediate transfer medium and scrapes off toner, and a toner reservoir member which is disposed to the scraping member along the width direction and holds toner scraped off from the intermediate transfer medium near a tip of the scraping member, and the controller executes density controlling processing of optimizing a density controlling factor which influences a density of an image based on detected densities of toner images which are control patch images which are formed while varying the density controlling factor, and the end patch images are formed at the same time that the control patch images are formed.

2. The image forming apparatus of claim 1, wherein the width of the cleaner is wider than a width of a maximum development area to which the developing unit can supply toner on the intermediate transfer medium via the latent image carrier, and outer-most ends of the end patch images along the width direction contain outer-most ends of the maximum development area along the width direction.

3. The image forming apparatus of claim 2, wherein the developing unit comprises multiple developers which store toner, and the controller makes the multiple developers each form the end patch images.

4. The image forming apparatus of claim 1, wherein the end patch images are formed only in the end areas.

5. The image forming apparatus of claim 1, wherein the end patch images are partially formed within the image forming region.

6. The image forming apparatus of claim 1, wherein the latent image carrier is a photosensitive member, an exposure unit is further disposed which irradiates a light beam upon a surface of the photosensitive member charged up to a predetermined surface potential and forms an electrostatic latent image, and after optimizing a developing bias applied upon the developing unit as a first density controlling factor, the controller executes, as the density controlling processing, processing of optimizing the intensity of the light beam as a second density controlling factor at thus optimized developing bias, and then forms the end patch images at thus optimized developing bias.

7. An image forming apparatus comprising:

a latent image carrier which carries an electrostatic latent image;

a developing unit which visualizes with toner the electrostatic latent image carried by the latent image carrier and forms a toner image;

an intermediate transfer medium to which the toner image is transferred from the latent image carrier and which rotates and transports the toner image to a predetermined transfer position and transfers the toner image to a recording medium;

a cleaner which abuts on the surface of the intermediate transfer medium and removes toner which adheres to the surface of the intermediate transfer medium after the transfer to the recording medium; and controller which, assuming that the direction which is orthogonal to the travel direction in which the intermediate transfer medium moves is a width direction, executes toner accumulating processing during which predetermined toner images are formed as end patch images in end areas of the surface of the intermediate transfer medium which are located on outer side along the width direction relative to an image forming region in which a toner image corresponding to size of the recording medium is formed and the cleaner then removes the end patch images, wherein the cleaner includes a blade-like scraping member which extends along the width direction, has a wider width than the width of the image forming region, abuts on the intermediate transfer medium and scrapes off toner, and a toner reservoir member which is disposed to the scraping member alone the width direction and holds toner scraped off from the intermediate transfer medium near a tip of the scraping member, two toner reservoir members are disposed at the both ends of the scraping member along the width direction, and the end patch images are formed within surface areas of the intermediate transfer medium which correspond to the locations at which the toner reservoir members are disposed along the width direction.

8. An image forming apparatus comprising:

a latent image carrier which carries an electrostatic latent image;

a developing unit which visualizes with toner the electrostatic latent image carried by the latent image carrier and forms a toner image;

an intermediate transfer medium to which the toner image is transferred from the latent image carrier and which rotates and transports the toner image to a predetermined transfer position and transfers the toner image to a recording medium;

a cleaner which abuts on the surface of the intermediate transfer medium and removes toner which adheres to the surface of the intermediate transfer medium after the transfer to the recording medium; and a controller which, assuming that the direction which is orthogonal to the travel direction in which the intermediate transfer medium moves is a width direction, executes toner accumulating processing during which predetermined toner images are formed as end catch images in end areas of the surface of the intermediate transfer medium which are located on outer side along the width direction relative to an image forming region in which a toner image corresponding to size of the recording medium is formed and the cleaner then removes the end patch images, wherein the cleaner includes a blade-like scraping member which extends along the width direction, has a wider width than the width of the image forming region, abuts on the intermediate transfer medium and scrapes off toner, and a toner reservoir member which is disposed to the scraping member along the width direction and holds toner scraped off from the intermediate transfer medium near a tip of the scraping member, the scraping member moves toward and away from the intermediate transfer medium, and the toner reservoir member accumulates the toner near the tip of the scraping member when the scraping member is away from the intermediate transfer medium, and feeds the accumulated toner to an abutting section of the scraping member and the intermediate transfer medium when the scraping member moves towards the intermediate transfer medium.

* * * * *